US009968157B2

(12) United States Patent
Wardlaw et al.

(10) Patent No.: US 9,968,157 B2
(45) Date of Patent: May 15, 2018

(54) SOLE FOR A SHOE

(71) Applicant: adidas AG, Herzogenaurach (DE)

(72) Inventors: Angus Wardlaw, Nuremberg (DE); John Whiteman, Nuremberg (DE); Tru Huu Minh Le, Erlangen (DE); Stuart David Reinhardt, Nuremberg (DE)

(73) Assignee: adidas AG, Herzogenaurach (DE)

( * ) Notice: Subject to any disclaimer, the term of this patent is extended or adjusted under 35 U.S.C. 154(b) by 303 days.

(21) Appl. No.: 14/178,853

(22) Filed: Feb. 12, 2014

(65) Prior Publication Data

US 2014/0223783 A1 Aug. 14, 2014

(30) Foreign Application Priority Data

Feb. 13, 2013 (DE) ..... 10 2013 202 306
Jan. 28, 2014 (EP) ..... 14152907

(51) Int. Cl.

| | |
|---|---|
| ***A43B 13/14*** | (2006.01) |
| ***A43B 5/00*** | (2006.01) |
| ***A43B 1/00*** | (2006.01) |
| ***A43B 13/12*** | (2006.01) |
| ***A43B 13/18*** | (2006.01) |

(52) U.S. Cl.
CPC ..... *A43B 5/00* (2013.01); *A43B 1/0009* (2013.01); *A43B 13/12* (2013.01); *A43B 13/125* (2013.01); *A43B 13/14* (2013.01); *A43B 13/181* (2013.01); *A43B 13/183* (2013.01); *A43B 13/185* (2013.01)

(58) Field of Classification Search
CPC ..... A43B 5/00; A43B 1/0009; A43B 13/12; A43B 13/125; A43B 13/14; A43B 13/181; A43B 13/183; A43B 13/185
USPC ..... 36/28, 107, 108
See application file for complete search history.

(56) References Cited

U.S. PATENT DOCUMENTS

| | | | |
|---|---|---|---|
| D64,898 | S | 6/1924 | Gunlock |
| 2,131,756 | A | 10/1938 | Roberts |
| 2,968,106 | A | 1/1961 | Joiner et al. |
| 3,186,013 | A | 6/1965 | Glassman et al. |
| 3,586,003 | A | 6/1971 | Baker |
| D237,323 | S | 10/1975 | Inohara |

(Continued)

FOREIGN PATENT DOCUMENTS

| | | |
|---|---|---|
| CN | 1034662 | 8/1989 |
| CN | 1036128 | 10/1989 |

(Continued)

OTHER PUBLICATIONS

U.S. Appl. No. 14/981,168, filed Dec. 28, 2015, Reinhardt et al., Unpublished.

(Continued)

*Primary Examiner* — Jila M Mohandesi
(74) *Attorney, Agent, or Firm* — Kilpatrick Townsend & Stockton LLP

(57) ABSTRACT

Improved soles for shoes, in particular sports shoes, are described. A sole for a shoe, in particular a sports shoe, is provided that includes a midsole with randomly arranged particles of an expanded material. The sole further includes an element having a higher deformation stiffness in at least one direction than the expanded material. The material of the midsole at least partially surrounds the element.

23 Claims, 8 Drawing Sheets

(56) References Cited

U.S. PATENT DOCUMENTS 4,132,016 A 1/1979 Vaccari
4,237,627 A 12/1980 Turner et al.
4,364,189 A 12/1982 Bates
4,481,727 A 11/1984 Stubblefield et al.
4,524,529 A 6/1985 Schaefer
4,546,559 A 10/1985 Dassler et al.
4,624,062 A 11/1986 Autry et al.
4,642,911 A 2/1987 Talarico et al.
4,658,515 A 4/1987 Oatman et al.
4,667,423 A 5/1987 Autry et al.
D296,262 S 6/1988 Brown et al.
4,754,561 A 7/1988 Dufour et al.
4,798,010 A 1/1989 Sugiyama et al.
D302,898 S 8/1989 Greenberg
RE33,066 E 9/1989 Stubblefield
4,864,739 A 9/1989 Maestri et al.
4,922,631 A 5/1990 Anderie et al.
4,970,807 A 11/1990 Anderie et al.
5,025,573 A 6/1991 Giese et al.
D329,731 S 9/1992 Adcock et al.
5,150,490 A 9/1992 Busch et al.
D333,556 S 3/1993 Purdom
D337,650 S 7/1993 Thomas, III et al.
D340,797 S 11/1993 Pallera et al.
5,283,963 A 2/1994 Lerner et al.
5,308,420 A 5/1994 Yang et al.
5,319,866 A * 6/1994 Foley ..... A43B 5/00 36/103
D350,016 S 8/1994 Passke et al.
D350,222 S 9/1994 Hase
D356,438 S 3/1995 Opie et al.
5,528,842 A * 6/1996 Ricci ..... A43B 13/12 36/103
5,549,743 A 8/1996 Pearce et al.
D375,619 S 11/1996 Backus et al.
5,617,650 A 4/1997 Grim
5,692,319 A 12/1997 Parker et al.
5,709,954 A 1/1998 Lyden et al.
D389,991 S 2/1998 Elliott
D390,349 S 2/1998 Murai et al.
D393,340 S 4/1998 Doxey
D395,337 S 6/1998 Greene
D408,618 S 4/1999 Wilborn et al.
D408,971 S 5/1999 Birkenstock
D413,010 S 8/1999 Birkenstock
D414,920 S 10/1999 Cahill
D415,610 S 10/1999 Cahill
D415,876 S 11/1999 Cahill
5,996,252 A 12/1999 Cougar
6,014,821 A 1/2000 Yaw
6,041,521 A 3/2000 Wong et al.
D422,400 S 4/2000 Brady et al.
D423,199 S 4/2000 Cahill
6,108,943 A 8/2000 Hudson et al.
D431,346 S 10/2000 Birkenstock
D460,852 S 7/2002 Daudier
6,516,540 B2 2/2003 Seydel et al.
6,702,469 B1 3/2004 Taniguchi et al.
6,708,426 B2 3/2004 Erickson et al.
D490,222 S 5/2004 Burg et al.
D490,230 S 5/2004 Mervar
D492,099 S 6/2004 McClaskie
6,782,640 B2 8/2004 Westin et al.
6,796,056 B2 9/2004 Swigart
D498,901 S 11/2004 Hawker et al.
6,874,257 B2 4/2005 Erickson et al.
6,925,734 B1 8/2005 Schaeffer et al.
6,948,263 B2 9/2005 Covatch
6,957,504 B2 10/2005 Morris
6,968,637 B1 * 11/2005 Johnson ..... A43B 3/0063 36/108
D517,302 S 3/2006 Ardissono
7,143,529 B2 12/2006 Robinson, Jr. et al.
D538,518 S 3/2007 Della Valle
7,202,284 B1 * 4/2007 Limerkens ..... C08G 18/08 521/113
7,243,445 B2 7/2007 Manz et al.
D554,848 S 11/2007 Marston
D560,883 S 2/2008 McClaskie
D561,433 S 2/2008 McClaskie
D561,438 S 2/2008 Belley
D561,986 S 2/2008 Horne et al.
D570,581 S 6/2008 Polegato Moretti
D571,085 S 6/2008 McClaskie
D572,462 S 7/2008 Hatfield et al.
7,421,805 B2 9/2008 Geer et al.
D586,090 S 2/2009 Turner et al.
D589,690 S 4/2009 Truelsen
D594,187 S 6/2009 Hickman
D596,384 S 7/2009 Andersen et al.
D601,333 S 10/2009 McClaskie
D606,733 S 12/2009 McClaskie
D607,190 S 1/2010 McClaskie
D611,233 S 3/2010 Della Valle
7,673,397 B2 3/2010 Jarvis
D616,183 S 5/2010 Skaja
D617,540 S 6/2010 McClaskie
D618,891 S 7/2010 McClaskie
D631,646 S 2/2011 Muller
D633,286 S 3/2011 Skaja
D633,287 S 3/2011 Skaja
D634,918 S 3/2011 Katz et al.
D636,156 S 4/2011 Della Valle
D636,569 S 4/2011 McMillan
D636,571 S 4/2011 Avar
7,941,941 B2 * 5/2011 Hazenberg ..... A43B 1/0009 36/25 R
D641,142 S 7/2011 Lindseth et al.
D644,827 S 9/2011 Lee
D645,649 S 9/2011 Mcclaskie
D648,105 S 11/2011 Schlageter et al.
D650,159 S 12/2011 Avar
8,082,684 B2 12/2011 Munns
D655,488 S 3/2012 Blakeslee
D659,364 S 5/2012 Jolicoeur
8,186,081 B2 5/2012 Wilson, III et al.
D680,725 S 4/2013 Avar et al.
D680,726 S 4/2013 Propét
D683,116 S 5/2013 Petrie
8,479,412 B2 7/2013 Peyton et al.
8,490,297 B2 7/2013 Guerra
D693,553 S 11/2013 McClaskie
D695,501 S 12/2013 Yehudah
D698,137 S 1/2014 Carr
D707,934 S 7/2014 Petrie
D709,680 S 7/2014 Herath
8,834,770 B2 9/2014 Nakano et al.
D721,478 S 1/2015 Avent et al.
9,010,157 B1 4/2015 Podhajny et al.
D739,129 S 9/2015 Del Biondi
D739,131 S 9/2015 Del Biondi
D740,003 S 10/2015 Herath
D740,004 S 10/2015 Hoellmueller et al.
9,167,868 B1 * 10/2015 Koo ..... A43C 1/00
9,167,869 B2 * 10/2015 Koo ..... A43B 3/102
9,212,270 B2 12/2015 Künkel et al.
D758,056 S 6/2016 Herath et al.
D776,410 S 1/2017 Herath et al.
D783,264 S 4/2017 Hoellmueller et al.
9,610,746 B2 4/2017 Wardlaw et al.
9,781,970 B2 10/2017 Wardlaw et al.
9,781,974 B2 10/2017 Reinhardt
9,788,598 B2 10/2017 Reinhardt
9,788,606 B2 10/2017 Reinhardt
2002/0162247 A1 11/2002 Hokkirigawa
2003/0131501 A1 7/2003 Erickson et al.
2003/0172548 A1 9/2003 Fuerst
2003/0208925 A1 11/2003 Pan
2004/0032042 A1 2/2004 Chi
2004/0211088 A1 10/2004 Volkart
2005/0065270 A1 3/2005 Knoerr et al.
2005/0108898 A1 5/2005 Jeppesen et al.
2005/0150132 A1 7/2005 Iannacone

(56) References Cited

U.S. PATENT DOCUMENTS

| | | | | |
|---|---|---|---|---|
| 2005/0241181 | A1 | 11/2005 | Cheng | |
| 2006/0010717 | A1 | 1/2006 | Finkelstein et al. | |
| 2006/0026863 | A1 | 2/2006 | Liu | |
| 2006/0083912 | A1 | 4/2006 | Park et al. | |
| 2006/0125134 | A1 | 6/2006 | Lin et al. | |
| 2006/0134351 | A1 | 6/2006 | Greene et al. | |
| 2006/0156579 | A1 | 7/2006 | Hoffer et al. | |
| 2006/0235095 | A1 | 10/2006 | Leberfinger et al. | |
| 2006/0283046 | A1 | 12/2006 | Mason | |
| 2007/0193070 | A1 | 8/2007 | Bertagna et al. | |
| 2007/0199213 | A1 | 8/2007 | Campbell et al. | |
| 2007/0295451 | A1 | 12/2007 | Willis | |
| 2008/0052965 | A1 | 3/2008 | Sato et al. | |
| 2008/0244932 | A1 | 10/2008 | Nau et al. | |
| 2008/0250666 | A1 | 10/2008 | Votolato | |
| 2009/0013558 | A1* | 1/2009 | Hazenberg | A43B 1/0009 36/88 |
| 2009/0025260 | A1 | 1/2009 | Nakano | |
| 2009/0113758 | A1* | 5/2009 | Nishiwaki | A43B 13/10 36/88 |
| 2009/0119023 | A1 | 5/2009 | Zimmer et al. | |
| 2009/0217550 | A1* | 9/2009 | Koo | A43B 3/102 36/91 |
| 2009/0235557 | A1 | 9/2009 | Christensen et al. | |
| 2009/0277047 | A1 | 11/2009 | Polegato Moretti | |
| 2009/0320330 | A1 | 12/2009 | Borel et al. | |
| 2010/0063778 | A1 | 3/2010 | Schrock et al. | |
| 2010/0122472 | A1 | 5/2010 | Wilson, III et al. | |
| 2010/0154257 | A1 | 6/2010 | Bosomworth et al. | |
| 2010/0218397 | A1 | 9/2010 | Nishiwaki et al. | |
| 2010/0222442 | A1* | 9/2010 | Prissok | C08G 18/4854 521/60 |
| 2010/0242309 | A1 | 9/2010 | McCann | |
| 2010/0287788 | A1 | 11/2010 | Spanks et al. | |
| 2010/0287795 | A1 | 11/2010 | Van Niekerk | |
| 2010/0293811 | A1 | 11/2010 | Truelsen et al. | |
| 2011/0047720 | A1 | 3/2011 | Maranan et al. | |
| 2011/0067272 | A1 | 3/2011 | Lin | |
| 2011/0232135 | A1 | 9/2011 | Dean et al. | |
| 2011/0252668 | A1 | 10/2011 | Chen | |
| 2011/0283560 | A1* | 11/2011 | Portzline | A43B 13/04 36/31 |
| 2011/0302805 | A1 | 12/2011 | Vito et al. | |
| 2012/0005920 | A1 | 1/2012 | Alvear et al. | |
| 2012/0047770 | A1 | 3/2012 | Dean et al. | |
| 2012/0177777 | A1 | 7/2012 | Brown et al. | |
| 2012/0233877 | A1 | 9/2012 | Swigart et al. | |
| 2012/0233883 | A1 | 9/2012 | Spencer et al. | |
| 2012/0235322 | A1 | 9/2012 | Greene et al. | |
| 2012/0266490 | A1 | 10/2012 | Atwal et al. | |
| 2012/0304491 | A1 | 12/2012 | Kimura et al. | |
| 2013/0150468 | A1 | 6/2013 | Füssi et al. | |
| 2013/0255103 | A1 | 10/2013 | Dua et al. | |
| 2013/0266792 | A1 | 10/2013 | Nohara et al. | |
| 2013/0269215 | A1 | 10/2013 | Smirman et al. | |
| 2013/0291409 | A1 | 11/2013 | Reinhardt et al. | |
| 2014/0017450 | A1 | 1/2014 | Baghdadi et al. | |
| 2014/0033573 | A1 | 2/2014 | Wills | |
| 2014/0066530 | A1 | 3/2014 | Shen et al. | |
| 2014/0075787 | A1 | 3/2014 | Cartagena | |
| 2014/0197253 | A1 | 7/2014 | Lofts et al. | |
| 2014/0223673 | A1 | 8/2014 | Wardlaw et al. | |
| 2014/0223776 | A1 | 8/2014 | Wardlaw et al. | |
| 2014/0223777 | A1 | 8/2014 | Whiteman et al. | |
| 2014/0227505 | A1 | 8/2014 | Schiller et al. | |
| 2014/0366403 | A1 | 12/2014 | Reinhardt et al. | |
| 2014/0366404 | A1 | 12/2014 | Reinhardt et al. | |
| 2014/0366405 | A1 | 12/2014 | Reinhardt et al. | |
| 2014/0373392 | A1 | 12/2014 | Cullen | |
| 2015/0082668 | A1 | 3/2015 | Nakaya et al. | |
| 2015/0089841 | A1 | 4/2015 | Smaldone et al. | |
| 2015/0166270 | A1 | 6/2015 | Buscher et al. | |
| 2015/0174808 | A1 | 6/2015 | Rudolph et al. | |
| 2015/0197617 | A1 | 7/2015 | Prissok et al. | |
| 2015/0237823 | A1 | 8/2015 | Schmitt et al. | |
| 2015/0344661 | A1 | 12/2015 | Spies et al. | |
| 2015/0351493 | A1 | 12/2015 | Ashcroft et al. | |
| 2016/0037859 | A1 | 2/2016 | Smith et al. | |
| 2016/0044992 | A1 | 2/2016 | Reinhardt et al. | |
| 2016/0046751 | A1 | 2/2016 | Spies et al. | |
| 2016/0121524 | A1 | 5/2016 | Däschlein et al. | |
| 2016/0128426 | A1 | 5/2016 | Reinhardt et al. | |
| 2016/0244583 | A1 | 8/2016 | Keppeler | |
| 2016/0244584 | A1 | 8/2016 | Keppeler | |
| 2016/0244587 | A1 | 8/2016 | Gutmann et al. | |
| 2016/0346627 | A1 | 12/2016 | Le et al. | |
| 2017/0173910 | A1 | 6/2017 | Wardlaw et al. | |

FOREIGN PATENT DOCUMENTS

| | | | |
|---|---|---|---|
| CN | 2511160 | | 9/2002 |
| CN | 2796454 | | 7/2006 |
| CN | 2888936 | | 4/2007 |
| CN | 101107113 | | 1/2008 |
| CN | 101190049 | | 6/2008 |
| CN | 201223028 | | 4/2009 |
| CN | 101484035 | | 7/2009 |
| CN | 101611950 | | 12/2009 |
| CN | 202233324 | | 5/2012 |
| CN | 202635746 | | 1/2013 |
| CN | 202907958 | | 5/2013 |
| CN | 103371564 | | 10/2013 |
| CN | 203262404 | | 11/2013 |
| CN | 203692653 | | 7/2014 |
| CN | 103976506 | | 8/2014 |
| CN | 203828180 | | 9/2014 |
| DE | 3605662 | | 6/1987 |
| DE | 4236081 | A1 | 4/1994 |
| DE | 19652690 | A1 | 6/1998 |
| DE | 19950121 | | 11/2000 |
| DE | 10010182 | | 9/2001 |
| DE | 10244433 | B4 | 12/2005 |
| DE | 10244435 | B4 | 2/2006 |
| DE | 102004063803 | | 7/2006 |
| DE | 102005050411 | | 4/2007 |
| DE | 202008017042 | U1 | 3/2009 |
| DE | 102008020890 | | 10/2009 |
| DE | 102009004386 | | 7/2010 |
| DE | 202010008893 | U1 | 12/2010 |
| DE | 112009001291 | | 4/2011 |
| DE | 102010052783 | | 5/2012 |
| DE | 202012005735 | | 8/2012 |
| DE | 102011108744 | A1 | 1/2013 |
| DE | 102012206094 | | 10/2013 |
| DE | 102013208170 | | 11/2014 |
| EM | 001286116-0001 | | 7/2011 |
| EM | 001286116-0002 | | 7/2011 |
| EM | 001286116-0003 | | 7/2011 |
| EM | 001286116-0004 | | 7/2011 |
| EM | 001286116-0005 | | 7/2011 |
| EM | 001286116-0006 | | 7/2011 |
| EP | 0165353 | | 12/1985 |
| EP | 752216 | | 1/1997 |
| EP | 0873061 | B1 | 10/1998 |
| EP | 1197159 | B1 | 4/2002 |
| EP | 1424105 | | 6/2004 |
| EP | 1854620 | A1 | 11/2007 |
| EP | 1872924 | | 1/2008 |
| EP | 2110037 | A1 | 10/2009 |
| EP | 2233021 | | 9/2010 |
| EP | 2250917 | | 11/2010 |
| EP | 2316293 | | 5/2011 |
| EP | 2342986 | | 7/2011 |
| EP | 2446768 | | 5/2012 |
| EP | 2649896 | | 10/2013 |
| EP | 2540184 | B1 | 7/2014 |
| EP | 2792261 | A1 | 10/2014 |
| EP | 2848144 | | 3/2015 |
| EP | 2939558 | | 11/2015 |
| EP | 3067100 | | 9/2016 |
| FR | 2683432 | | 5/1993 |
| GB | 2258801 | | 2/1993 |
| JP | 01274705 | | 11/1989 |

(56) References Cited

FOREIGN PATENT DOCUMENTS

| | | | |
|---|---|---|---|
| JP | 10152575 | | 6/1998 |
| JP | 2913603 | | 6/1999 |
| JP | 2000197503 | | 7/2000 |
| JP | 2002-325602 | | 11/2002 |
| JP | 2002361749 | | 12/2002 |
| JP | 2005095388 | | 4/2005 |
| JP | 2005218543 | | 8/2005 |
| JP | 2008073548 | | 4/2008 |
| JP | 2009-142705 | | 7/2009 |
| JP | 2009-535157 | | 10/2009 |
| JP | 2012-249744 | | 12/2012 |
| KR | 1020110049293 | | 5/2011 |
| TW | 201012407 | | 4/2010 |
| WO | 8906501 | | 7/1989 |
| WO | 1994020568 | A1 | 9/1994 |
| WO | 2005026243 | A1 | 3/2005 |
| WO | WO 2005066250 | | 7/2005 |
| WO | WO 2006015440 | | 2/2006 |
| WO | 2006/034807 | A1 | 4/2006 |
| WO | WO 2007082838 | | 7/2007 |
| WO | 2008047538 | A1 | 4/2008 |
| WO | WO 2008087078 | | 7/2008 |
| WO | 2009039555 | | 4/2009 |
| WO | 2009095935 | | 8/2009 |
| WO | 2010010010 | | 1/2010 |
| WO | 2010037028 | | 4/2010 |
| WO | 2010038266 | | 4/2010 |
| WO | 2010045144 | | 4/2010 |
| WO | WO 2010136398 | | 12/2010 |
| WO | 2011134996 | A1 | 11/2011 |
| WO | 2012065926 | | 5/2012 |
| WO | 2013013784 | | 1/2013 |
| WO | 2013168256 | | 11/2013 |
| WO | 2014046940 | | 3/2014 |
| WO | 2015052265 | A1 | 4/2015 |
| WO | 2015052267 | A1 | 4/2015 |
| WO | 2015075546 | A1 | 5/2015 |

OTHER PUBLICATIONS

U.S. Appl. No. 29/550,418, filed Jan. 4, 2016, Galway et al., Unpublished.
U.S. Appl. No. 62/137,139, filed Mar. 23, 2015, Gordon et al., Unpublished.
Venable LLP, Letter, dated Jan. 14, 2016, 6 pages.
European Patent Application No. 14152903.2, European Search Report, dated Sep. 5, 2014 (8 pages).
U.S. Appl. No. 14/473,274, filed Aug. 29, 2014, Reinhardt et al., Unpublished.
U.S. Appl. No. 14/473,168, filed Aug. 29, 2014, Reinhardt et al., Unpublished.
U.S. Appl. No. 14/472,847, filed Aug. 29, 2014, Reinhardt et al., Unpublished.
U.S. Appl. No. 29/558,138, filed Mar. 15, 2016, Hoellmueller et al., Unpublished.
U.S. Appl. No. 15/078,043, filed Mar. 23, 2016, Tru, Huu Minh L., Unpublished.
U.S. Appl. No. 15/130,012, filed Apr. 15, 2016, Kormann, Marco et al., Unpublished.
European Patent Application No. 14152907.3, Office Action dated Nov. 2, 2015, 5 pages.
U.S. Appl. No. 15/093,233, filed Apr. 7, 2016, Wardlaw, Angus et al., Unpublished.
U.S. Appl. No. 14/823,227, filed Aug. 11, 2015, Paul Leonard Michael Smith, et al., Unpublished.
U.S. Appl. No. 14/825,690, filed Aug. 13, 2015, Stuart David Reinhardt, et al., Unpublished.
Chinese Patent Application No. 201410049624.2,Office Action dated Aug. 13, 2015, 8 pages (No English translation available. A summary of the Office Action is provided in the accompanying Transmittal Letter).
European Patent Application No. 14152907.3, European Search Report dated Jun. 23, 2014, 6 pages.
Baur et al., "Saechtling Kunststoff Taschenbuch", Hanser Verlag, 31. Ausgabe, Oct. 2013, 18 pages (9 pages for the original document and 9 pages for the English translation).
Gunzenhausen et al., "The right turn (part 1)—Determination of Characteristic values for assembly injection molding", Journal of Plastics Technology, Apr. 2008, pp. 1-8 (English translation of Abstracted provided).
U.S. Appl. No. 29/464,051, filed Aug. 12, 2013, Galway, et al., Unpublished.
U.S. Appl. No. 29/464,038, filed Aug. 12, 2013, Herath., Unpublished.
U.S. Appl. No. 29/464,055, filed Aug. 12, 2013, Hoellmueller, et al., Unpublished.
U.S. Appl. No. 29/463,139, filed Aug. 12, 2013, Herath., Unpublished.
U.S. Appl. No. 14/178,720, filed Feb. 12, 2014, Wardlaw, et al., Unpublished.
U.S. Appl. No. 14/178,581, filed Feb. 12, 2014, Wardlaw, et al., Unpublished.
U.S. Appl. No. 14/179,090, filed Feb. 12, 2014, Whiteman, et al., Unpublished.
https://www.britannica.com/print/article/463684, Aug. 17, 2016, 15 pgs.
Colour and Additive Preparations for Extruded Polyolefin Foams, Gabriel-Chemie Group, available at www.gabriel-chemie.com/downloads/folder/PE%20foams_en.pdf, last accessed on Jan. 17, 2017, 20 pages.
http://www.dow.com/polyethylene/na/en/fab/foaming.htm, Dec. 7, 2011, 1 page.
Nauta, "Stabilisation of Low Density, Closed Cell Polyethylene Foam", University of Twente, Netherlands, 2000, 148 pages.
U.S. Appl. No. 15/581,112, Unpublished (filed Apr. 28, 2017).
U.S. Appl. No. 29/591,016, Unpublished (filed Jan. 16, 2017).
U.S. Appl. No. 29/592,935, Unpublished (filed Feb. 3, 2017).
U.S. Appl. No. 29/592,946, Unpublished (filed Feb. 3, 2017).
U.S. Appl. No. 29/594,228, Unpublished (filed Feb. 16, 2017).
U.S. Appl. No. 29/594,358, Unpublished (filed Feb. 17, 2017).
U.S. Appl. No. 29/595,852, Unpublished (filed Mar. 2, 2017).
U.S. Appl. No. 29/595,857, Unpublished (filed Mar. 2, 2017).
U.S. Appl. No. 29/595,859, Unpublished (filed Mar. 2, 2017).
U.S. Appl. No. 29/614,532, Unpublished (filed Aug. 21, 2017).
U.S. Appl. No. 29/614,545, Unpublished (filed Aug. 21, 2017).
U.S. Appl. No. 15/703,031, Unpublished (filed Sep. 13, 2017).
U.S. Appl. No. 15/724,318, Unpublished (filed Oct. 4, 2017).
Office Action, Japanese Patent Application No. 2014-021187, dated May 9, 2017.
Office Action, Japanese Patent Application No. 2014-021187, dated Aug. 8, 2017.
AZO Materials , "BASF Develops Expanded Thermoplastic Polyurethane", available http://www.azom.com/news.aspxNewsID=37360, Jul. 2, 2013, 4 pages.
Amendment in Response to Office Action, Japanese Patent Application No. 2013-083657, filed Feb. 28, 2018.
Office Action, Japanese Patent Application No. 2013-083657, dated Dec. 5, 2018.

* cited by examiner

SOLE FOR A SHOE

CROSS REFERENCE TO RELATED APPLICATION

This application is related to and claims priority benefits from German Patent Application No. DE 10 2013 202 306.5, filed on Feb. 13, 2013, entitled SOLE FOR A SHOE ("the '306 application"), and from European Patent Application No. EP 14 152 907.3, filed on Jan. 28, 2014, entitled SOLE FOR A SHOE ("the '907 application"). The '306 and '907 applications are hereby incorporated herein in their entireties by this reference.

FIELD OF THE INVENTION

The present invention relates to a sole for a shoe, in particular a sports shoe.

BACKGROUND

By means of soles, shoes are provided with a lot of properties which, according to the specific type of the shoe, may be strongly varying in their effect. Primarily, shoe soles have a protective function. By their stiffness, which is higher than that of the shaft, they protect the foot of the respective wearer from injuries caused by sharp objects, for example, on which the wearer may tread. Furthermore, the shoe sole protects the shoe, as a rule, against excessive abrasion. In addition, shoe soles may improve the contact of a shoe with the respective ground and thus facilitate faster movements. A further function of a shoe sole may comprise providing certain stability. Moreover, a shoe sole may have a cushioning effect, so as to, e.g., absorb the forces emerging from the contact of the shoe with the ground. Finally, a shoe sole may protect the foot against dirt or spray water or provide a plurality of other functionalities.

In order to satisfy all these functionalities, different materials are known from the prior art which may be used for manufacturing shoe soles. Exemplarily, shoe soles made of ethylene-vinyl-acetate (EVA), thermoplastic polyurethane (TPU), rubber, polypropylene (PP) or polystyrene (PS) are mentioned here. Each of these materials provides a special combination of different properties which are more or less well suited for soles of specific shoe types, depending on the specific requirements of the respective shoe type. For example, the TPU is very abrasion-resistant and tear-proof. Furthermore, EVA is characterized by a high stability and a relatively good cushioning property. Furthermore, the use of expanded materials, in particular of expanded thermoplastic urethane (eTPU), was taken into consideration for the manufacture of a shoe sole. Expanded thermoplastic urethane is characterized by a low weight and particularly good elasticity and cushioning properties. In addition, according to WO 2005/066250, a sole of expanded thermoplastic urethane may be attached to a shoe shaft without needing any additional adhesives. Another example of a shoe sole on the basis of eTPU as well as a manufacturing method thereof are described in DE 10 2005 050 411 A1.

However, one disadvantage of the embodiments disclosed in WO 2005/066250 has to do with the fact that the properties of the sole are affected continuously in areas by the sole of expanded TPU and that a more detailed influence of the sole properties is not possible according to WO 2005/066250.

In order to further influence the properties of the sole selectively, the use of additional functional elements, such as, e.g., a reinforcing element, is known from prior art. Such a reinforcing element may, for instance, be glued on the bottom side of the sole so as to increase the stability of the sole in selected regions such as, e.g., the medial region of the midfoot. Such a reinforcement may serve to relieve the whole movement apparatus (e.g., foot, ankle, knee, tendons, ligaments and so forth), for example when jogging on uneven ground or in case of an over pronation of the foot.

For example, EP 1 197 159 B1 discloses a shoe construction method and shoe obtained thereof, among the various construction methods for these products by injection, whether open, semi open, or closed, incorporating a wedge, with or without a stiffening midsole for said wedge, attached to a stitching insole which is secured to the sole or intermediate outsole.

One disadvantage of the functional elements and sole configurations known from the prior art is, however, the fact that the shoe sole and the additional elements, which selectively influence the properties and the functionality of the sole, have to be manufactured separately and have subsequently to be bonded, e.g., glued together. This may restrict the possibilities of influencing the properties of the sole by the additional functional elements. This means, in particular, that the functional element cannot move independently from regions of the sole which are in contact with it. For example, this may lead to the effect that the additional element, though causing an improvement of the properties of the sole in a first direction, e.g. reinforcement in longitudinal direction, at the same time causes an undesired deterioration of the properties of the sole in a second direction, e.g. perpendicular to the first direction. This is true, in particular, for flatly designed elements. Furthermore, only such materials may be used which may be glued together. This restricts the selection of materials and hence the design possibilities of the sole and the shoe significantly. A further disadvantage of functional elements which are fixed or glued to the bottom side of the sole is that these elements may influence the behavior of the shoe negatively during contact with the ground. So, such an element may, for example, lead to a slipping of the foot on uneven ground (e.g. on stones or roots) and thus to a fall of the wearer.

Starting from prior art, it is therefore an objective of the present invention to provide better soles for shoes, in particular sports shoes. A further objective of the present invention comprises providing improved possibilities to influence the properties of shoe soles by means of additional elements.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a sole for a shoe, in particular a sports shoe, comprises a midsole which comprises randomly arranged particles of an expanded material, wherein the sole further comprises an element which, in at least one direction, comprises a higher deformation stiffness than the expanded material and wherein the material of the midsole surrounds the element at least partially.

In certain embodiments, the element extends at least partially inside the material of the midsole.

In further embodiments, the element is not bonded the expanded material of the midsole.

By a simultaneous use of particles of expanded material and an additional element which comprises a higher deformation stiffness in at least one direction than the expanded material, a great freedom of design results with respect to the midsole. So, the element may, for instance, have a preferred direction in which it moves together with the rolling movement of the foot, and, at the same time comprise a blocking direction in which it is less or not flexible at all. Furthermore, only one partial region may, for instance, comprise particles of the expanded material, e.g. expanded TPU, for example, a region in the forefoot area, in particular below the big toe, and/or in the heel area. This design leads to a particularly good cushioning when the foot impacts on and is pushed off the ground, and to a low loss of energy during a step, due to the good elasticity and cushioning properties of the expanded TPU. At the same time, the additional element may be completely or partially embedded in the midsole, for example, in the midfoot region, or extend at least partially in other regions of the midsole inside the material of the midsole. If the element is embedded completely or almost completely in the midsole, there is no impediment when the foot is impacting on the ground, as the element is not in contact with the tread surface of the sole. In addition, the properties of the different regions of the sole can be influenced substantially independently from each other. If the element is, however, only partially embedded in the midsole or encompassed by it, respectively, the element may additionally influence the properties of the surface of the sole.

Furthermore, in some embodiments, materials may be used for the manufacture of the additional element which cannot be glued together with the material of the midsole, in particular the expanded material of the midsole, since the element need not comprise a bond with the expanded material. Such materials are often less expensive than glueable materials. Other criteria for selecting the materials for an element are, e.g., materials that serve to reduce weight, or non-abrasion-resistant materials which increase the stability of the sole. By way of example, polypropylene and polyethylene are mentioned here as possible materials.

In further embodiments, however, the element may also comprise a bond with the material of the midsole, in particular, with the expanded material of the midsole. This bond may further increase the stability of the sole. Such a bond may, for example, be achieved by melting and merging the materials of the element and of the midsole. In certain embodiments, an additional thermoplastic urethane in powder form is added, which may lead to a better bond between the element and the material, in particular the expanded material, of the midsole.

In certain embodiments, the use of randomly arranged particles of the expanded material may be beneficial. These particles significantly facilitate the manufacture of such a sole, since the particles may be handled in a particularly easy manner and no alignment whatsoever is necessary during manufacture due to their random arrangement.

As already mentioned, the element, according to the requirement profile of the sole and the shoe, may be manufactured from one or more different materials, e.g.: plastics, expanded materials with other properties than the other expanded material of the sole, foils, two- and three-dimensional fabrics, wood, metal, and the like. In principle, the element may further comprise a plurality of forms, like, e.g., various corners and angles, different widths, lengths and heights, etc. In addition, the element may be embedded at least partially at different locations and in different orientations in the midsole, such as, e.g., in the upper, central or lower region of the midsole, and it may extend to the forefoot region or the heel area or to both regions or may lie diagonally in the midsole and the like. Embodiments of an element are described in greater detail in the following.

In certain embodiments, the particles of the expanded material, from which the midsole is at least partially comprised, comprise one or more of the following materials: expanded ethylene-vinyl-acetate (eEVA), expanded thermoplastic urethane (eTPU), expanded polypropylene (ePP), expanded polyamide (ePA), expanded polyether block amide (ePEBA), expanded polyoxymethylene (ePOM), expanded polystyrene (PS), expanded polyethylene (ePE), expanded polyoxyethylene (ePOE), and expanded ethylene propylene diene monomer (eEPDM). According to the requirement profile of the sole, one or more of these materials may be used advantageously for the manufacture due to their substance-specific properties.

In further embodiments, the midsole is designed such that the expanded material at least partially surrounds the element. Preferably, the element extends at least partially throughout the expanded material of the midsole. Thereby, at least a partial connection between the element and the expanded material may be achieved without the need for a bond. This design increases the constructive freedom and thus the possibilities of a precisely coordinated influence on the properties of the sole, in particular of the regions with expanded material. In particular, also non-glueable materials, as discussed above, may be used.

In further embodiments, as already mentioned, there may be an additional bond between the midsole, in particular the expanded material of the midsole, and the element, e.g. an adhesive bond, a fusion bond or a bond achieved by adding thermoplastic urethane in powder form.

In further embodiments, the sole may be manufactured by first inserting the element into a mold which is subsequently filled with the particles of the expanded material of the midsole. Thereby, it is possible, for example, to arrange the element within the expanded material without having to cut it open and close it again after insertion of the element. As described above, thermoplastic urethane in powder form may be optionally added in such a case in order to create a bond between the element and the expanded material, should this be desired. By using particles of a suitable size and an appropriate method for inserting the particles into the mold, it can furthermore be ensured that the particles flow around and/or surround the element at the intended locations, so that there are less holes and/or flaws in the expanded material, for example underneath and/or behind the element. This simplifies the manufacturing process of such a sole significantly.

In further embodiments, the particles of the expanded material of the midsole are subjected to a heating and/or pressurization and/or steaming process after filling them into the mold. Thereby, the surfaces of the particles may be melted at least partially, so that the particle surfaces bond together after cooling. Furthermore, by the heating and/or pressurization and/or steaming process, the particles may also form a bond due to a chemical reaction. Such a bond is very robust and durable and does not require a use of further bonding substances, for example adhesives. This makes the manufacture of the sole, inter alia, simpler, safer, more cost-effective and more environment-friendly.

In some embodiments, the element extends at least partially like a skeleton throughout the material of the midsole, preferably throughout the expanded material of the midsole. A skeleton-like structure allows the selective influence on the properties of the sole together with weight reduction.

In further embodiments, the element comprises a plurality of rod-shaped sections. This allows also the selective influence on the properties of the sole together with weight reduction and has the additional advantage that rectilinear, rod-shaped elements or elements including such partial elements can be manufactured particularly easily.

In further embodiments, the element may also be asymmetrical, helical, designed as a modular element and/or consist of different materials. The element can, for example, comprise a core or basic element of one material and adjacent portions of one or further different materials, which are manufactured as an integral piece via injection molding. In further embodiments, partial modules of an element may subsequently be fixed to or inserted into the basic element. The element may comprise different thicknesses or curvatures or a cross-shaped or star-shaped diameter for an optimum anchoring with a maximum surface in the material of the midsole, in particular in the expanded material. Furthermore, the different regions or arms or parts of the element may comprise different flexibilities and therefore be tailored in accordance with the requirements of the shoe.

In further embodiments, the element comprises hollow sections at least in sections. This feature allows for a further reduction of weight and furthermore increases the stability of the element, in particular that of a skeleton-like and/or rod-shaped element or parts thereof.

In some embodiments, the element is at least partially grid-like. A grid-like element permits, according to the size of the grid, to influence the properties of the sole in a relatively large, flat region, while at the same time saving weight in comparison to, e.g., a flat area-like element. This feature applies in particular if the element comprises, as described above, hollow sections at least partially. Moreover, a grid-like element simplifies the manufacturing process, since, as mentioned above, the particles of the expanded material can flow around it or surround it more easily. This reduces the formation of flaws in the expanded material. The same applies also to skeleton- and rod-shaped elements.

A grid-like element may comprise one or more regions where the grid structure is more close-meshed or wide-meshed than in one or more other regions.

In further embodiments, the grid-like element may also serve to bridge, in the heel area (or in other areas), an open region in the sole and thereby give the sole a trampoline structure. Examples of embodiments of a grid element used for this purpose and of further grid-like elements for shoe soles which can be advantageously combined with the aspects of the present invention described herein are, for example, described in US 2005/0108898 A1 and EP 0 873 061 B1.

According to additional embodiments of the invention, the element comprises a recess for receiving an electronic component. Such a component may, for example, be a GPS transmitter/receiver and may serve to determine the position, the current running speed, the covered distance, the distance to destination or any kind of information related to position or speed. Furthermore, the element may, for example, include a radio receiver and a storage element, so that, for example, the current heart frequency, as transmitted by a heart rate monitor, can be stored. The component may also provide multiple functionalities, e.g. a GPS transmitter/receiver, a radio receiver and a memory, so that the heart rate can be stored depending on the position data along a specific route.

Furthermore, electronic components may be integrated in other elements or may form, as a structure, an element themselves. By way of example, embodiments of a structure of electronic components which may be combined with aspects of the present invention are described in US 2010/0063778 A1, for example. Further examples of electronic components are: optical sensors, sensors with electrodes (conductive material); near field communication tags or chips; pressure sensors; flexible displays at peripheral zones; control panels; LED units; a battery which can be charged inductively from the outside and so forth.

In some embodiments, the recess for receiving the component is arranged in a region of the element which is not surrounded by the midsole on every side. This design enables access to the recess for receiving the electronic component. Hence, the component may be exchanged, for example, in order to replace it by another component that provides a further functionality, or to change the power supply of the component.

According to further embodiments of the invention, the sole comprises a heel clip that is arranged at the material of the midsole. Preferably, the heel clip is fixed to the expanded material of the midsole. The heel clip serves to better fix the foot on the sole or in the shoe, respectively. A good fixation is necessary, for example, to prevent the formation of blisters during walking or running, respectively.

In further embodiments, the heel clip comprises a recess in the region of the Achilles' tendon. The latter prevents the heel clip, in particular its upper edge, from pressing on the Achilles' tendon when the foot rolls and pushes off the ground or from rubbing against it, which may lead to painful irritations and injuries of the Achilles' tendon. As a result, the recess increases the wear comfort of the shoe and helps avoid injuries.

In further embodiments, the heel clip comprises a medial and a lateral finger that are designed to independently encompass the medial and the lateral sides of the heel, respectively. This increases the wear comfort and freedom of movement even more, while also ensuring a sufficient fixation of the foot in the shoe. This feature leads to a further prevention of injuries.

In additional embodiments, the heel clip comprises only one finger, for example a finger that is arranged laterally or medially or centrally.

In further embodiments, the heel clip and the element are provided as one integral piece. This design increases the stability of the shoe construction and simplifies the manufacture. In particular, material such as adhesives, for example, and additional work steps are not required.

According to certain embodiments of the invention, the sole furthermore comprises a cage element arranged at the midsole, preferably at the expanded material of the midsole, and which is designed to three-dimensionally encompass an upper at a lateral and/or medial side. The cage element serves, inter alia, to fix the foot in the shoe.

In certain embodiments, the cage element, the element and/or the heel clip are provided as one integral piece. This design increases the stability of the shoe construction and simplifies the manufacture. In particular, material, such as, e.g., adhesives or sewing thread, and additional work steps are not necessary.

In further embodiments, the element at least partially encompasses a part of the expanded material on the side in order to selectively limit the deformation of the expanded material. This design, in turn, may again influence the cushioning properties of the expanded material and the stability of the sole.

According to additional embodiments of the invention, an outsole layer is arranged in at least a partial region of the element. Such an outsole serves to protect the sole against wear and may increase the grip on the ground and the slip resistance of the sole.

In some embodiments, the element may hereby be connected with the outsole, so that the element may be easily inserted into a tool, which considerably simplifies the manufacturing process.

According to additional embodiments of the invention, the element comprises at least a first plate element and a second plate element that may slide relative to each other.

In certain embodiments, the first plate element may slide relative to the second plate element in various directions.

In further embodiments, the first plate element and the second plate element each comprise a curved sliding surface.

As additional embodiments, the material of the midsole provides a restoring force counteracting a sliding movement of the first plate element relative to the second plate element.

In certain embodiments, two plate elements which are mounted substantially horizontally in the heel area of the midsole and which may move relative to each other in various directions and whose relative movement is counteracted by a restoring force provided by the midsole material may be used to receive horizontal shearing forces which influence the movement of the wearer when running. This reduces the wear of the joints and the risk of injuries of the wearer of a shoe having such a sole. Examples of embodiments of such plate elements which are movable relative to each other and which, according to the embodiments of the invention described here, may be combined are found, for example, in DE 102 44 433 B4 and DE 102 44 435 B4.

The element may further comprise at least one grommet defining a passage through the material of the midsole.

In particular, the grommet may define a passage from the bottom side of the midsole throughout the thickness of the midsole to its top side. The passage may be left as empty space. It may also comprise a breathable material, preferably a breathable material that does not allow moisture to penetrate through the passage towards the top side of the midsole. In this way, a ventilation opening in the midsole can be created. This may help cool a wearer's foot and prevent excessive sweating, for example. The grommet may also help reduce the weight of the sole by saving midsole material in the passageway, in particular if left as empty space.

The at least one grommet may further comprise a hexagonal flange. Preferably, the element comprises a clima unit, which comprises a plurality of grommets arranged in a honeycomb pattern.

By providing the grommet with a hexagonal flange, stability is provided to the grommet and at the same time not too much midsole space is occupied by the grommet. In particular if a plurality of grommets is to be arrange in the midsole, forming a clima unit e.g. in the heel region or the forefoot region, a hexagonal flange of the grommets allows arranging them in a honeycomb pattern. This may provide the clima unit with good stability and at the same time allow a high "packing rate" of the grommets, resulting in a compact clima unit.

Additional embodiments of the invention concern a shoe, in particular a sports shoe, with a sole according to one of the preceding embodiments. Here, single aspects of the mentioned embodiments and aspects of the invention may be combined, according to the requirement profile of the sole and the shoe. Furthermore, it is possible to leave aside individual aspects, if these should be of no importance for the respective purpose.

BRIEF DESCRIPTION OF THE DRAWINGS

In the following detailed description, embodiments of the invention are described referring to the following figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following detailed description, embodiments of the invention are described with reference to sports shoes. However, it is emphasized that the present invention is not limited to these embodiments. For example, the present invention may also be used for safety shoes, casual shoes, trekking shoes, golf shoes, winter shoes or other shoes.

Figure 1:
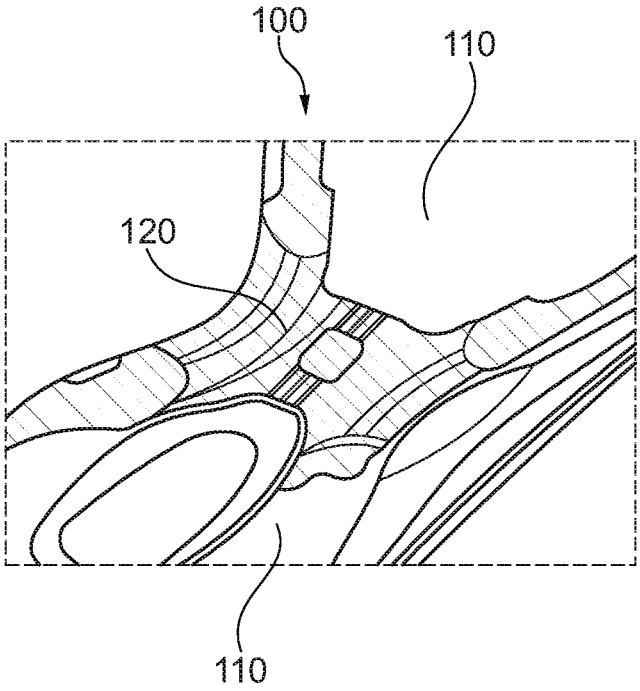
Fig. 1 PRIOR ART
FIG. 1 is a perspective view of a conventional reinforcing element fixed to the sole.

FIG. 1 shows embodiments of the prior art. FIG. 1 shows, in particular, a sole 100 with a flat reinforcing element 120, which is glued on the material 110 of the sole. Such embodiments have, as already mentioned above, some disadvantages. On one hand, these embodiments are limited to materials that may be bonded together, and particularly glued together. The necessity of a bond between the materials also increases the manufacturing effort, the amount of bonding agents required and hence also the manufacturing effort, and furthermore limits the possibilities of influencing the properties of the sole 100. In addition, the reinforcing element 120 that is fixed, e.g. glued, to the bottom side of the sole has the disadvantage that the reinforcing element 120 may have a negative influence on the behavior of the sole 100 when impacting on the ground. Thus, for instance, the reinforcing element 120 may lead to a slipping of the foot when uneven ground is stepped on (e.g., on stones or roots), thus causing the wearer to fall.

Figure 2:
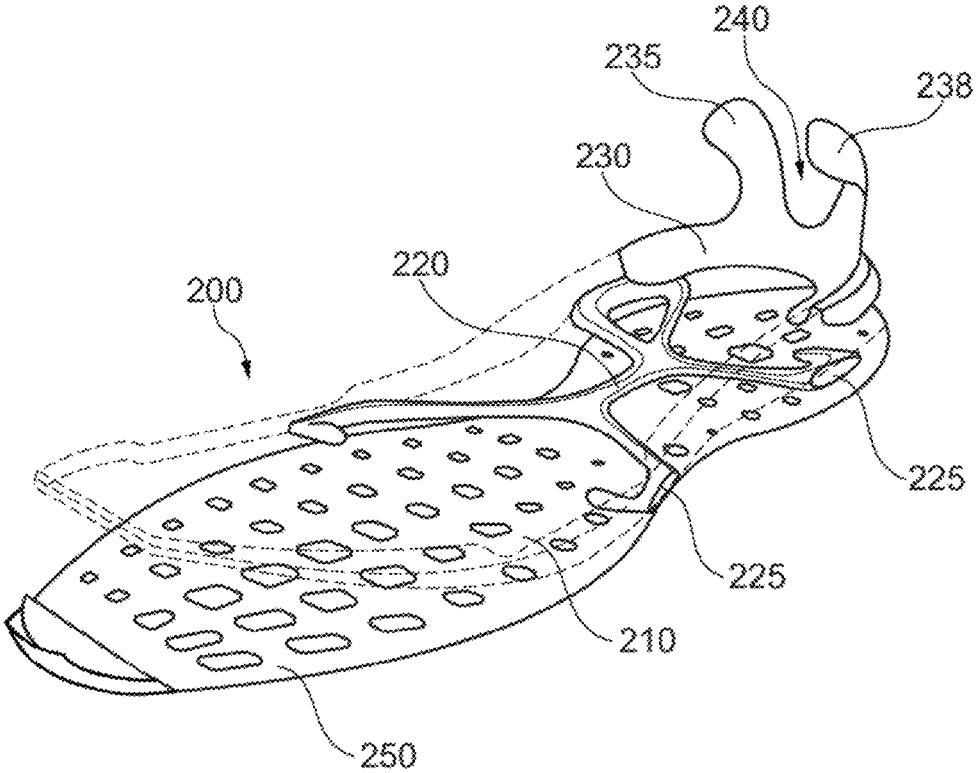
FIG. 2 is a perspective view of a shoe sole with a skeleton-like reinforcing element, a heel clip which comprises a lateral and a medial finger, as well as a recess in the region of the Achilles' tendon, and an outsole, according to certain embodiments of the present invention.

FIG. 2 shows a sole 200 according to certain embodiments of the present invention. The sole 200 comprises a midsole 210, a deformation/reinforcing element 220, a heel clip 230 and an outsole 250.

The midsole 210 comprises randomly arranged particles of an expanded material. In some embodiments, the whole midsole 210 comprises expanded material. Here, however, different expanded materials or mixtures of various expanded materials may be used in different partial regions of the midsole 210. In further embodiments, only one or several partial regions of the midsole 210 comprise expanded material, while the rest of the midsole 210 comprises non-expanded material. By a suitable combination of different expanded and/or non-expanded materials, a midsole 210 with the desired cushioning and stability properties may be manufactured. The particles of the expanded material may comprise, in particular, one or more of the following materials: expanded ethylene-vinyl-acetate (eEVA), expanded thermoplastic urethane (eTPU), expanded polypropylene (ePP), expanded polyamide (ePA), expanded polyether block amide (ePEBA), expanded polyoxymethylene (ePOM), expanded polystyrene (PS), expanded polyethylene (ePE), expanded polyoxyethylene (ePOE), and expanded ethylene propylene diene monomer (eEPDM). Each of these materials comprises specific characteristic properties which, according to the profile requirements for the sole, may be used advantageously for the manufacture of the shoe sole. So, in particular, the eTPU has excellent cushioning properties that remain unchanged also at lower or higher temperatures. Furthermore, eTPU is very elastic and, in the case of compression which may occur when the foot impacts on the ground, the eTPU returns the stored energy almost completely to the foot during subsequent expansion. This increases the efficiency of the movement. In contrast thereto, ePP has an increased stability together with a very low weight. In certain embodiments, the midsole 210 comprises partial regions of eTPU in the forefoot region (and in particular beneath the toes) and in the heel area, while the rest of the midsole 210 comprises ePP, eEVA, or another expanded or non-expanded material. A midsole 210 comprising eTPU in the forefoot and heel area and ePP in the remaining zones protects the foot and the joints of the wearer against injuries, due to good cushioning properties of eTPU and low weight of ePP, which keeps the weight of the sole low. Such a combination may be advantageous for a sole of a running shoe, for example.

The midsole 210 further surrounds at least partially an element 220, which in the embodiments shown in FIG. 2 is a deformation or reinforcing element. In certain embodiments, the element 220 has, in at least one direction, a higher deformation stiffness than the expanded material of the midsole 220. In further embodiments, the element 220 may, for example, also be an outsole and/or an ornamental element and/or an element for receiving an electronic component and/or an electronic component or any other functional element.

In certain embodiments, as shown in FIG. 2, the element 220 is almost completely surrounded by the midsole 210. In these embodiments, the element 220 extends at least partially throughout the inside of the material of the midsole 210. Only the two linear regions 225, as well as the corresponding portions at the opposite side of the midsole 210, are partially visible from outside the sole 200. In certain embodiments, the element 220 is not bonded, e.g. by an adhesive bond, with the midsole 210. In particular, in certain embodiments, the element 220 has no adhesive bond with the expanded material of the midsole 210. In certain embodiments, the element 220 is furthermore surrounded at least partially by the expanded material of the midsole 210, wherein the element 220 may extend at least partially throughout the inside of the expanded material. Because the midsole 210 at least partially surrounds the element 220, a bond for fixing the element 220 is not necessary. Therefore, non-glueable materials may be used for manufacturing the sole. In alternative embodiments, the element 220 may be additionally connected with the midsole 210 by a bond. The additional connection may be used for increasing the stability of the bond between the element 220 and the midsole 210, if desired. In further embodiments, the element 220 is surrounded by the midsole 210 only in a small portion, e.g. approximately half, or approximately one fourth, or any other portion.

In these embodiments, as shown in FIG. 2, the element 220 extends skeleton-like through the material, and may extend through the expanded material, of the midsole 210. If the midsole 210 comprises, as described above, different regions of expanded and/or non-expanded materials or material mixes, the element 220 may extend, in further embodiments, through all or some or even only one of these regions. In this case, as already described above based on examples of embodiments, in principle a large number of two-dimensional and/or three-dimensional embodiments and orientations of the element 220 are possible. In certain embodiments, the element 220, as shown in FIG. 2, is designed skeleton-like. This design allows considerable material and weight savings, for example, as compared to a flat element, while it is still possible to control the properties, such as, e.g., the stiffness or the stability of the sole, in a larger area. The deformation/reinforcing element 220 shown in FIG. 2 allows, for example, an increase of stability and deformation stiffness of the whole midfoot region with reduced material usage and hence low weight of the element 220. This configuration allows ultimately the construction of a very light sole, e.g. of a sole with a weight of less than 200 g, which may further have a weight less than 150 g, and which may even further have a weight less than 100 g, and which still has sufficient stability. The use of such a light element 220 allows also the use of very light materials such as, e.g., eEVA and/or ePP for the construction of the midsole 210, which could not be used without the element 220, as they do not comprise the stability which is necessary for a shoe sole.

In further embodiments, the element 220 comprises several partial elements that protrude at least partially from the midsole 210 and/or are arranged within the midsole 210. These partial elements, for example, may be combined to form a structure.

According to certain embodiments of the invention, the element 220 may further be arranged centrally, in peripheral zones, as well as symmetrically or asymmetrically in the respective region, depending on whether the element 220 is to influence the deformation of the sole to a higher or lower degree in the corresponding region.

If the element 220, according to some embodiments, is not bonded with the material, in particular with the expanded material, of the midsole 210 (e.g. a deformation bar within the midsole 210), this element 220 may move together with the running movement. Thereby, the running movement is less impeded and the movement of the element 220 is decoupled at least partially from the deformation of the sole.

In further embodiments, the element 220, as shown in FIG. 2, comprises a number of rod-shaped sections. This design simplifies the manufacture of the element 220, for example, as compared to an element 220 showing a plurality of differently curved sections. In further embodiments, the element 220 is designed grid-like at least in part.

The use of a skeleton- and/or rod- and/or grid-like element 220 further simplifies the manufacturing process of the sole 200. For example, the element 200 may be first inserted into a mold which subsequently is filled with the particles of the expanded material. The skeleton- and/or rod- and/or grid-like design of the element 220 ensures that the particles of the expanded materials flow around or surround the element 220 in a sufficient amount at the intended locations, e.g. also beneath or behind the element 220, so that faults in the manufacture of the midsole are avoided. After filling the mold with the particles of the expanded material, the particles may, for example, be subjected to a heating and/or pressurization and/or steaming process, so that they combine and fix the element 220 in its position. Thereby, in certain exemplary embodiments, the particles of the expanded material do not combine in an adhesive bond with the element 220. In further embodiments, the particles of the expanded material, for example by adding TPU in powder form, form a bond with the element 220.

In further embodiments, the element 220 comprises hollow sections. This may further increase the stability or the deformation stiffness of the element 220, e.g., if the element comprises a number of rod-shaped, hollow sections, and may lead to a further reduction in weight.

Furthermore, a hollow section of the element 220 may serve to receive an electronic or other component, for example. Such an electronic component may, e.g. be a GPS transmitter/receiver and may serve to determine the position, the current running speed, the distance covered, the distance to destination or to determine any kind of information related to position and speed. Furthermore, the element may contain, e.g., a radio receiver and a storage element, so that, for example, the current heart rate, as it is for instance transmitted by a heart rate monitor, may be continuously stored. The component may also provide multiple functionalities, for example a GPS transmitter/receiver, a radio receiver and a memory, so that, for example, the heart rate may be stored depending on the position data along a specified route. In certain embodiments, such a hollow section of the element 220, which is destined for receiving an electronic component, is located in a region which is not completely surrounded by the midsole, as, for instance, the regions 225. This enables the access to the electronic component from outside, e.g. for exchanging the component against another component with modified functionality, or for exchanging the power supply.

In the embodiments shown in FIG. 2, the sole 200 furthermore comprises a heel clip 230. The heel clip 230 is arranged at the midsole 210 and/or surrounded at least partially by the midsole 210. In some embodiments, the heel clip 230 is in direct contact with the material, and may be in direct contact with the expanded material of the midsole 210, and is arranged at it. In further embodiments, the heel clip 230 is surrounded at least partially by the material of the midsole 210. According to the respective design of the midsole 210 and of the heel clip 230, the heel clip 230 is only fixed in its position by the material of the midsole 210 which surrounds the heel clip 230, without there being a bond with the midsole 210. If desired, the heel clip 230 may additionally be glued, sewn, riveted etc. to the midsole 210, in order to increase the stability of the shoe. In the embodiments shown in FIG. 2, the element 220 and the heel clip 230 are two separate parts. In further embodiments, the element 220 and the heel clip 230 are provided as an integral piece. In addition to the above-mentioned functions, the element 220 may thus serve to fix the heel clip 230 without the need for an adhesive bond with the midsole 230. This allows, for example, eliminating adhesives in the manufacture and enables the use of non-glueable materials. In further embodiments, the heel clip 230 may be additionally or exclusively bonded with regions of the midsole, such as, e.g. a glued bond, as already mentioned above.

The heel clip 230, as shown in FIG. 2, comprises a lateral finger 235 and a medial finger 238, which encompasses the lateral and the medial sides of the heel, respectively, independently from each other. This enables a good fixation of the foot on the sole 200, without, at the same time, limiting the freedom of movement of the foot. This may be of importance, for example, for running shoes or football shoes for which a good fixation of the foot along with a great freedom of movement is important. In further embodiments, the heel clip 230 furthermore comprises a recess 240 in the region of the Achilles' tendon. This recess 240 prevents in particular a rubbing or chafing of the upper edge of the heel clip 230 on the Achilles' tendon in the region above the heel, in particular when the wearer pushes his foot off the ground, since this is typically accompanied by a stretching of the foot. Such an irritation of the Achilles' tendon can lead to painful injuries and inflammations, which should be avoided.

The embodiments of a shoe sole 200 shown in FIG. 2 further comprise an outsole 250. Such an outsole 250 serves to further protect the foot and also the midsole and, in addition, to improve the grip on the ground of the shoe. The outsole 250 may, for this purpose, be manufactured of various materials, e.g. rubber, and may be profiled in many different ways. As a result, the outsole may for example comprise a number of holes and/or ribs in order to prevent a slipping of the shoe on the ground.

Figure 3A:
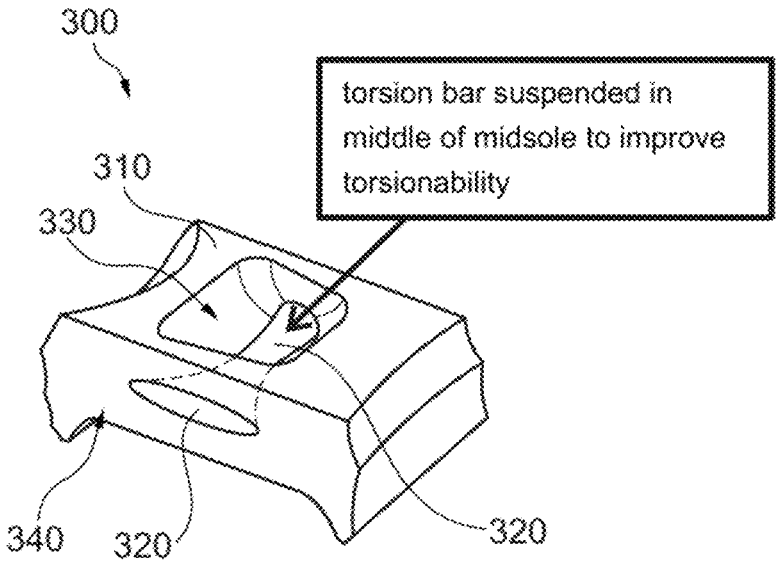
FIGS. 3*a-b* are perspective views of a shoe sole with a deformation element which is partially surrounded by a midsole, according to certain embodiments of the present invention.
Figure 3B:
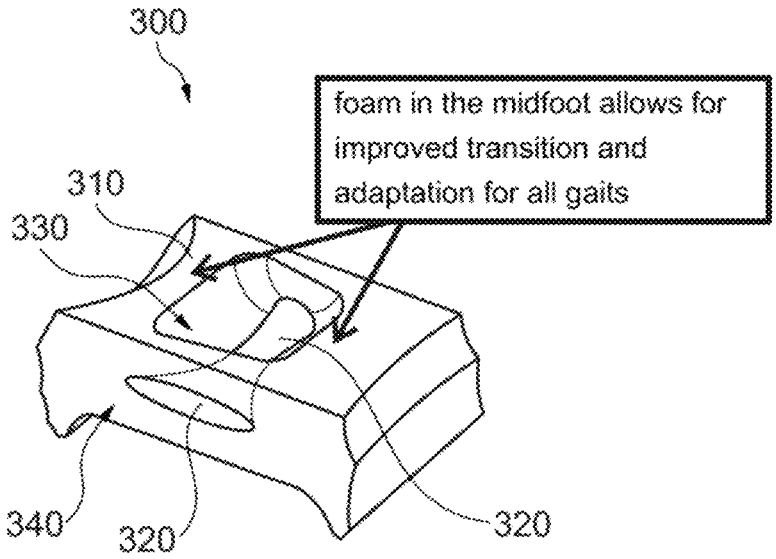

FIG. 3*a* and FIG. 3*b* show a part 300 of a sole according to further embodiments of the present invention, which in this case comprises a deformation element surrounded at least partially by the midsole 310. In certain embodiments, the region which is shown in FIG. 3*a* and FIG. 3*b* is located in the midfoot region of the sole.

According to the invention, the material of the midsole 310 comprises expanded material, for example particles of one or more of the expanded materials described above.

As can be seen from FIG. 3*a* and FIG. 3*b*, in particular from the cross-section 340 through the midsole 310, the deformation element 320 is surrounded in one region from all sides by the midsole 310, while the deformation element 320 is accessible from outside in other regions, in particular in the region of the recess 330. In certain embodiments, the deformation element 320 is hollow in the region of the recess 330 of the midsole 310 and serves to receive an electronic component, as described above. The recess 330 hence allows access to the electronic component from outside. In further embodiments, the recess 330 is arranged such that access to the electronic component is possible from inside or from a side of the shoe.

Furthermore, the recess 330 also influences the properties of the sole, in particular the stability and the deformation stiffness of the midsole 310 (cf. FIG. 3*b*). As shown in FIG. 3*a* and FIG. 3*b*, in certain embodiments, the deformation element 320 is rod-shaped in the region of the recess 330, which may be located in the midfoot region, while the deformation element has a significantly broader cross-section in the direction of the forefoot region or of the heel area (cf. cross-sectional area 340). This design enables an increase in stiffness of the sole in the direction of the heel towards the foot tip, i.e. in the direction of the longitudinal axis of the shoe, which may have an advantageous effect on the wearing properties of the shoe. For instance, this design may minimize the risk of injury on uneven ground. The rod-shaped design of the deformation element 320 in the region of the recess 330 in the midfoot region also enables an independent torsional movement of the forefoot region and of the heel area around the longitudinal axis of the shoe (cf. FIG. 3*a*) or a control of same by the deformation element. This feature may, for example, increase the impact area of the foot on uneven ground and thus lead to an increased wearing comfort and reduced risk of injury for the wearer.

Figure 4:
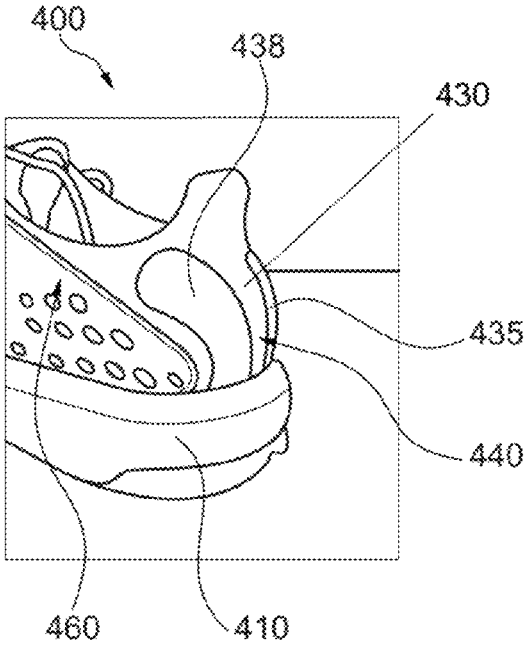
FIG. 4 is a perspective view of a shoe with a heel clip comprising a lateral and a medial finger, as well as a recess in the region of the Achilles' tendon, according to certain embodiments of the present invention.

FIG. 4 shows a shoe 400 according to further embodiments of the present invention with a midsole 410 that comprises particles of an expanded material. The shoe 400 further comprises a heel clip 430 which has a lateral finger 435 and a medial finger 438 that encompass the heel three-dimensionally and independently from each other, thus serving to fix the foot in the shoe.

In certain embodiments, the heel clip 430 is surrounded at least partially by the expanded material of the midsole 410 and thereby fixed to the midsole 410. In further embodiments, the heel clip 430 is additionally or exclusively fixed to the midsole 410 by an adhesive bond. In further embodiments, the heel clip 430 is fixed to the midsole 410, e.g. by gluing and/or sewing and/or another bond. In some embodiments, the heel clip 430 may also be designed as an integral piece with an element which is surrounded by the midsole 410 at least partially, without entering into a bond with the expanded material of the midsole 410. Thereby, the heel clip 430 may also be fixed to the midsole 410 without need for a bond with the expanded material of the midsole 410.

The heel clip 430 furthermore comprises a recess 440 in the region of the Achilles' tendon. This serves, as described above, to prevent injuries and/or irritations of the Achilles' tendon, in particular with running shoes.

In some embodiments, as shown in FIG. 4, the recess 440 reaches down to the midsole 410. This design leads to a higher flexibility of the lateral finger 435 and of the medial finger 438 and hence to an increased freedom of movement for the foot.

The shoe 400 further comprises an upper 460. The upper 460 may comprise one piece or, as shown in FIG. 4, comprise various different parts and materials. In some embodiments, the upper 460 is glued to the lateral finger 435 and the medial finger 438 of the heel clip 430. In further embodiments, no bond exists between the upper 460 and the fingers 435 and 438 of the heel clip 430, but both fingers 435, 438 are placed with light pressure from the outside on the heel area of the upper 460.

Figure 5:
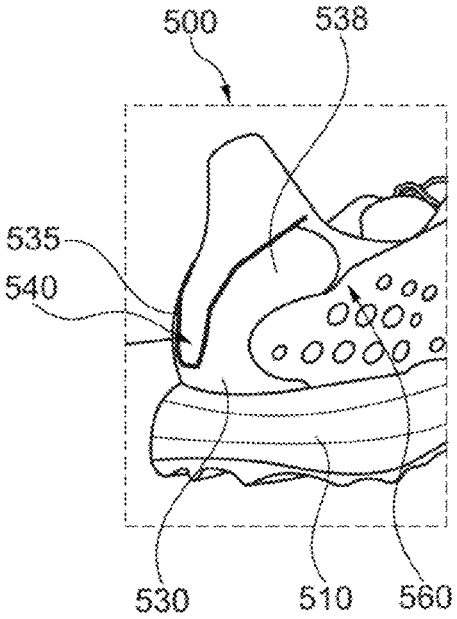
FIG. 5 is a perspective view of a shoe with a heel clip which comprises a lateral and a medial finger, as well as a recess in the region of the Achilles' tendon, according to certain embodiments of the present invention.

FIG. 5 illustrates further embodiments of a shoe 500 with a midsole 510 and a heel clip 530 with a lateral finger 535, a medial finger 538, and a recess 540 in the region of the Achilles' tendon. The shoe 500 further comprises a shoe upper 560. In principle, the same considerations and design possibilities exist for the embodiments of a shoe 500, as shown in FIG. 5, as for the embodiments of a shoe 400, as shown in FIG. 4. In contrast to the embodiments of the shoe 400, as shown in FIG. 4, the recess 540 of the embodiments of the shoe 500, as shown in FIG. 5, does not completely reach down to the midsole 510. This design feature of shoe 500 leads to an increased stability of the lateral finger 535 and the medial finger 538 and thus to an improved fixation of the foot in the shoe 500.

Figure 6:
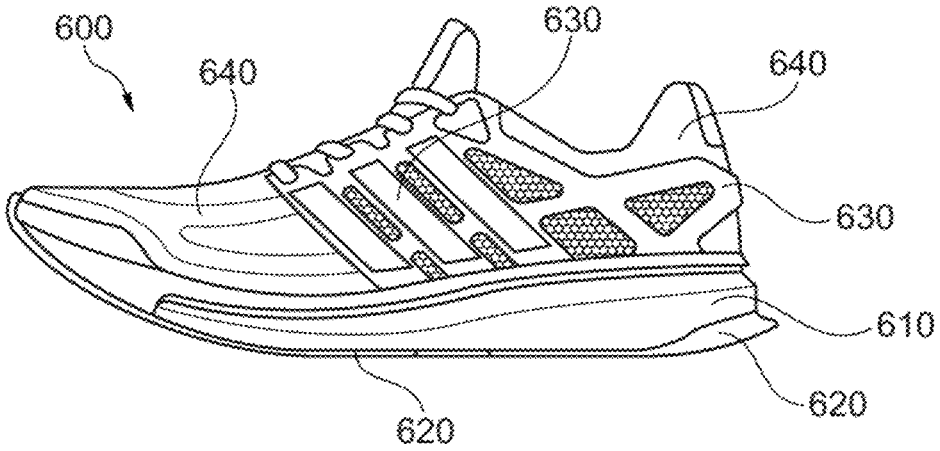
FIG. 6 are side and top views of a shoe with a cage element which three-dimensionally encompasses an upper, according to certain embodiments of the present invention.
Figure 6:
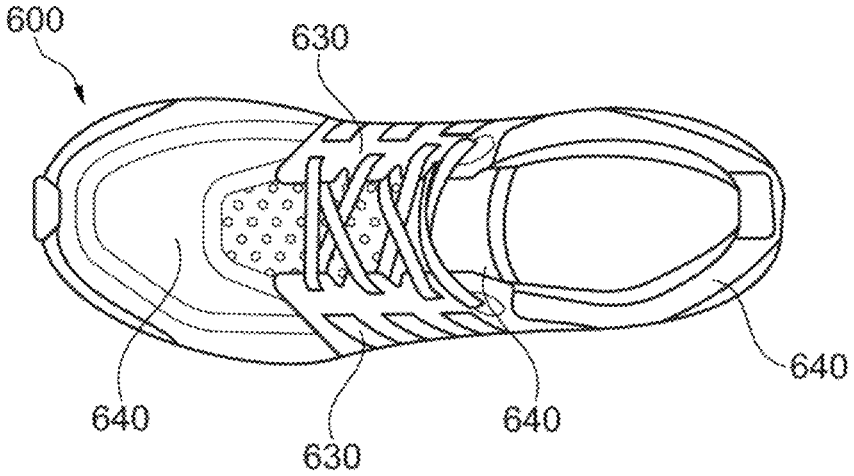

FIG. 6 shows a shoe according to further embodiments of the present invention. The shoe 600 comprises a midsole 610 which, in some embodiments, comprises particles of an expanded material, for example on or more of the above-mentioned materials. The shoe 600 further comprises an outsole 620 that may improve the grip of the shoe on the ground, as already described above.

In addition, the shoe 600 comprises a shoe upper 640 which, as already mentioned, may comprise one single piece or else various different parts. In the latter case, several or all parts may be bonded and/or sewn and/or riveted together or be bonded in some other manner. In these embodiments, as shown in FIG. 6, the upper 640 is further encompassed three-dimensionally by a cage element 630 at the medial and the lateral side, which is arranged at the midsole 610. Like a heel clip, there are also different possibilities to affix the cage element 630 to the midsole 610. An exemplary embodiment of an upper fixed to a sole, which may be combined with various aspects of the present invention which are described herein, is, for example, described in US 2007/0266594 A1. In some embodiments, the cage element 630 is provided as an integral piece with an element and/or a heel clip, wherein the element is at least partially surrounded by the midsole 610. This allows a fixation of the cage element 630 to the midsole 610. In further embodiments, the cage element 630 is fixed to the midsole 610, for example by a bond, e.g. by gluing. The cage element 630 serves to fix the foot in the shoe and on the sole and may in particular provide a possibility to receive a shoelace by means of which the cage element 630 may be contracted and fixed over the instep of the foot. The upper 640 may serve as padding between the foot and, e.g. a heel clip and/or the cage element 630, which in certain embodiments may itself comprise a heel clip, and which protects the foot from dirt, cold or injuries during use.

Figure 7:
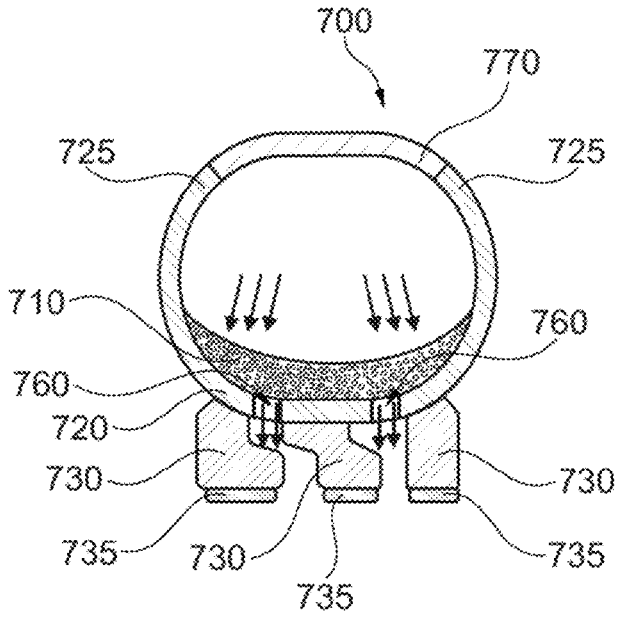
FIG. 7 is a cross-section of a shoe with a midsole and an element, wherein the midsole partially surrounds the element and wherein the element and a cage element are designed as an integral piece, as well as one or more layers of outsoles, according to certain embodiments of the present invention.

FIG. 7 shows a cross-section through a shoe 700 according to further embodiments of the invention. The shoe comprises a midsole 710 that contains particles of an expanded material, wherein the particles may be formed of one or more of the above-mentioned materials.

The shoe furthermore comprises an element 720, which is at least partially surrounded by the midsole 710. In certain embodiments, the element 720 is provided as an integral piece together with a cage element 725 and has no bond with the expanded material of the midsole 710. The shoe 700 furthermore comprises one or more outsole layers 735, which are fixed to the outsole elements 730, in order to improve the grip on the ground of the shoe 700, as already discussed above. The outsole elements 730 are, for their part, bonded with the element 720 or manufactured together with it as an integral piece. In some embodiments, the element 720 further comprises a number of openings 760 that are arranged between the outsole elements 730. The openings 760 provide better ventilation for the foot during use of the shoe, which may be advantageous during sports activities such as running, particularly in connection with a midsole 710 of breathable material, and more particularly when the breathable material comprises randomly arranged particles of an expanded material. In further embodiments, the shoe also comprises a tongue 770 or some other additional element which serves to protect and fix the foot in the shoe 700.

Figure 8:
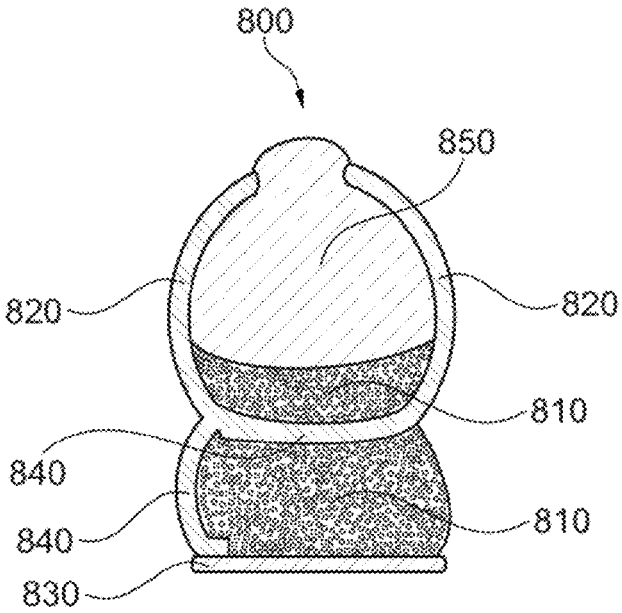
FIG. 8 is a cross-section of a shoe with a midsole and an element, wherein the midsole partially surrounds the element, and wherein the element and a cage element are provided as an integral piece, and wherein the element at least partially encompasses a part of the expanded material on the side, as well as an outsole layer, according to certain embodiments of the present invention.

FIG. 8 shows a cross-section through a shoe 800 according to further embodiments of the invention. The shoe comprises a midsole 810 that contains particles of an expanded material, wherein the particles may be formed of one or more of the above-mentioned materials.

The shoe further comprises an element comprising a cage element 820 and a part 840 that at least partially encompasses a part of the expanded material of the midsole 810 on the side. Since the expanded material of the midsole 810 is partially encompassed on the side by part 840 of the element, and since the element may have higher deformation stiffness than the expanded material of the midsole 810, the compressibility in vertical direction (i.e. in the direction from the foot towards the ground) of the midsole 810 may be reduced in the vicinity of the part 840, since the expanded material of the midsole 810 is prevented from evading to the side by the part 840 of the element. This design may, for example, be used for reinforcing the midsole 810 in the medial region of the midfoot in order to counteract an over pronation of the foot, for example.

In some embodiments, the element is provided as an integral piece and has no adhesive bond with the expanded material of the midsole 810. However, the element may be surrounded in part by the midsole 810 and thereby fixed to the latter. The shoe 800 further comprises an outsole layer 830 which is fixed to the part 840 of the element which laterally surrounds the expanded material, in order to improve the grip on the ground of the shoe 800, for example. In further embodiments, the shoe further comprises an upper 850, as already discussed above, or some other additional element which serves to protect and fix the foot in the shoe 800.

Figure 9:
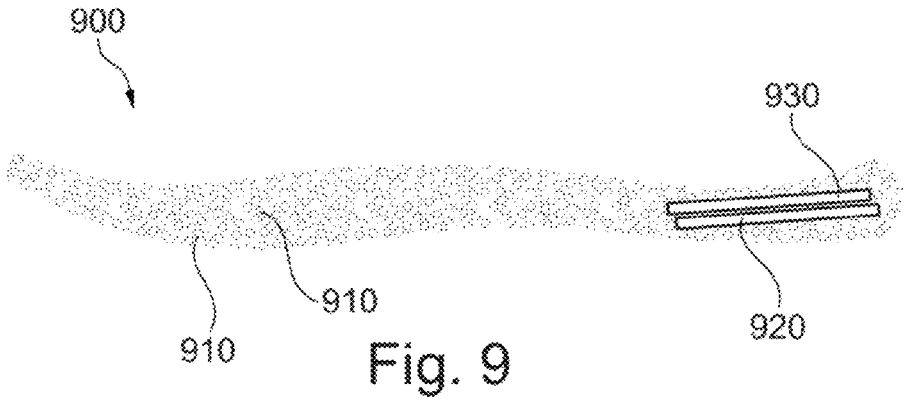
FIG. 9 is a side view of a midsole with an element which comprises a first and a second plate element which can slide relative to each other, according to certain embodiments of the present invention.

FIG. 9 shows certain embodiments of a midsole 900 that comprises randomly arranged particles 910 of an expanded material. In these embodiments, as shown in FIG. 9, the whole midsole comprises expanded material. However, it is clear to the skilled person that this merely represents an exemplary embodiment of a midsole 900 according various embodiments of the invention, and that in other embodiments, only one or more partial regions of the midsole may comprise particles 910 of an expanded material, as already described several times. The midsole 900 further comprises an element that comprises a first plate element 920 and a second plate element 930, which may slide relative to each other. In certain embodiments, the plate elements 920 and 930 may execute a sliding movement in several directions. In some embodiments, the two plate elements 920 and 930 are completely surrounded by the material of the midsole 900, wherein the material may be the expanded material of the midsole 900. In further embodiments, the plate elements 920 and 930 are, however, surrounded only partially by the material of the midsole 900.

The two plate elements 920 and 930, as shown in FIG. 9, may be arranged in the heel area of the midsole 900 such that they are located directly facing each other. In further embodiments, there is a lubricant or a gel between the two plate elements 920 and 930, which counteracts wear of the plate elements 920, 930 caused by the sliding movement and facilitates sliding. By the sliding movement of the two plate elements 920 and 930, such an arrangement may, for example, absorb or reduce the horizontal shearing forces that impact the movement of the wearer when his foot treads on the ground. This design prevents joint wear and injuries to the wearer, in particular during fast running/walking. In further embodiments, such plate elements as described here and in the following may also be arranged in other regions of a sole, for instance, in order to further support a rolling movement of the foot during running.

Figure 10:
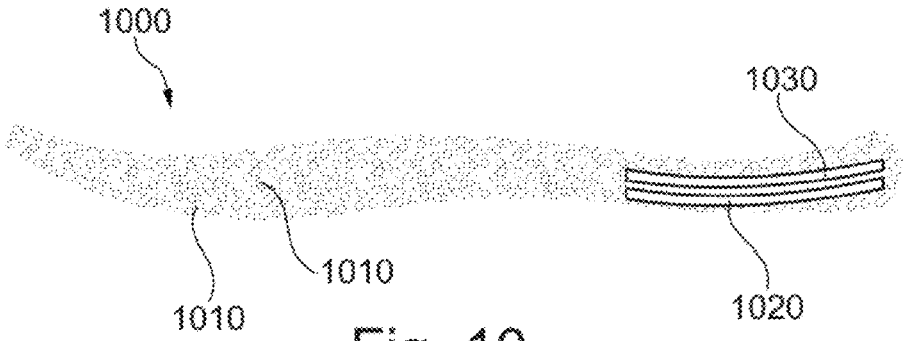
FIG. 10 is a side view of a midsole with an element which comprises a first and a second plate element which can slide relative to each other, wherein the plate elements comprise a curved surface, according to certain embodiments of the present invention.

FIG. 10 shows further embodiments of a midsole 1000 which comprises randomly arranged particles 1010 of an expanded material. The midsole 1000 further comprises an element which, as already described above, comprises a first and a second plate element 1020, 1030 which may slide relative to each other, preferably in several directions. One or both of the two plate elements 1020, 1030 may further comprise a curved sliding surface. In some embodiments, the curvature of the two sliding surfaces is chosen such that the two sliding surfaces match each other positively. In addition, an appropriate selection of the degree and orientation of the curvature may influence the direction in which the sliding movement of the first plate element 1020 compared to the second plate element 1030 preferably takes place, e.g. when treading on the ground. This, in turn, influences the shearing forces that are absorbed or transmitted to the wearer.

Further embodiments of an element which comprises two plate elements which may slide relative to each other and may be advantageously combined with the embodiments described just now can be found in DE 102 44 433 B4 and DE 102 44 435 B4, the entire contents of each of which are incorporated herein in their entireties.

Figure 11:
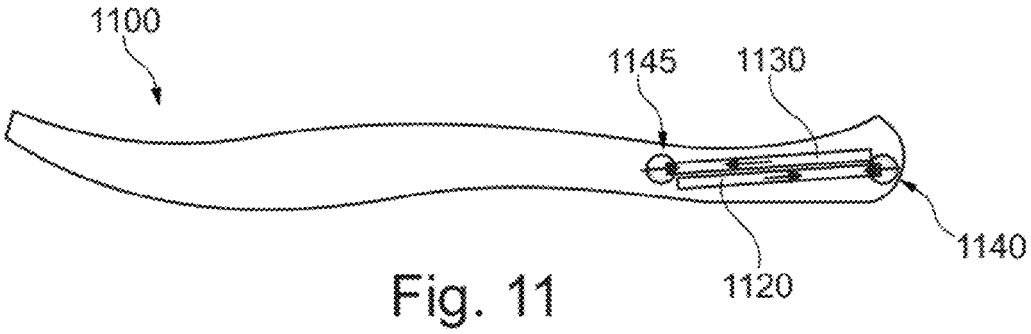
FIG. 11 is a side view of a midsole with an element which comprises a first and a second plate element which can slide relative to each other, wherein the material of the midsole provides a restoring force against the sliding movement, according to certain embodiments of the present invention.

For the functionality described just now, it may be further advantageous if the material of the midsole 1140, 1145, as shown in the embodiments in FIG. 11, provides a restoring force counteracting the sliding movement of the two plate elements 1120 and 1130. In certain embodiments, this restoring force is made possible by the fact that the two plate elements 1120 and 1130 are surrounded by the material of the midsole 1100, in particular by the expanded material of the midsole 1100, and that the material of the midsole 1100 is compressed by the movement of the first or second plate element 1120, 1130, respectively, in the regions 1140, 1145, which are adjacent to the two plate elements 1120, 1130 in the direction of the sliding movement. Due to the elastic properties of the material, in particular the expanded material of the midsole 1100, a restoring force is produced which counteracts the sliding movement of the first or second plate element 1120, 1130, respectively, without a need for complicated mechanics to this effect.

Figure 12:
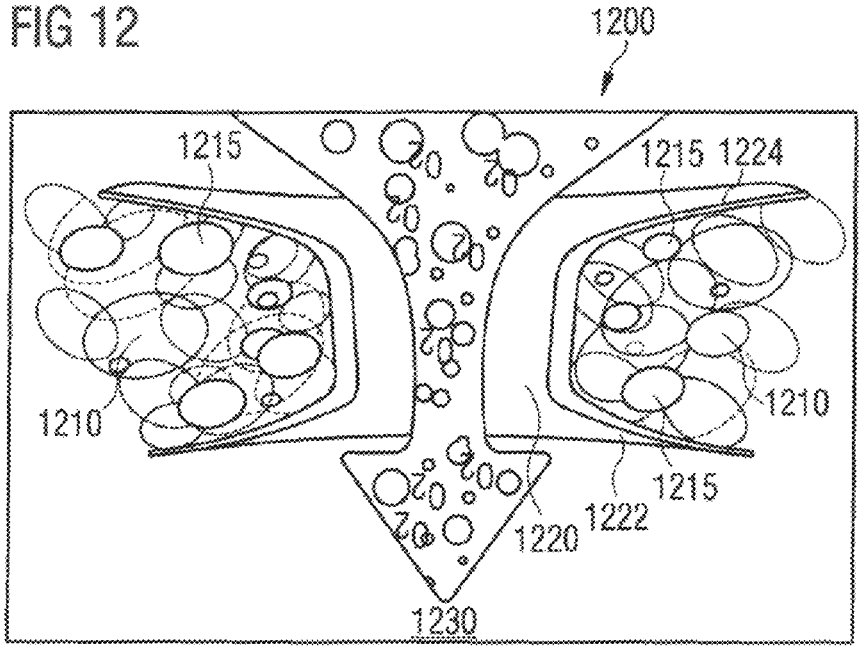
FIG. 12 is a cross-section of a sole with a grommet defining a passage through the material of the midsole, according to certain embodiments of the present invention.

FIG. 12 shows certain embodiments of a sole 1200 that comprises a midsole 1210 comprising randomly arranged particles 1215 of an expanded material. The sole 1200 further comprises an element 1220, wherein the material of the midsole 1210 surrounds the element 1220 at least partially. In particular, the expanded material of the midsole 1210 surrounds the element 1220 at least partially.

The element 1220 shown in FIG. 12 is provided as a grommet having a bottom flange 1222 and a top flange 1224. The bottom flange 1222 and/or the top flange 1224 may be hexagonal, i.e., the rim of the flanges 1222, 1224 may have a hexagonal shape when looked upon from the top or bottom side of the grommet 1220 in the direction of the passage 1230.

The flanges 1222, 1224 may, however, also comprise a different shape, they may e.g. be round, oval, rectangular, etc. Hexagonal flanges 1222, 1224 may have the advantage that a plurality of grommets 1220 may be arranged in a honeycomb patter to form a clima unit, cf. FIG. 13.

The flanges 1222, 1224 allow the grommet 1220 to be secured within the midsole 1210 without the addition of a bonding agent like a glue by simply surrounding the grommet 1220 by the material of the midsole 1210, in particular the expanded material of the midsole 1210 comprising the randomly arranged particles 1215. For example, the grommet 1220 may be inserted into a mold first, which is subsequently loaded with the particles 1215 and after further processing steps like closing the mold and a steam/pressure/heat treatment, the midsole 1210 may be produced containing the grommet 1220 fixed in its place.

Alternatively or in addition, the grommet 1220 may also be connected to the material of the midsole 1210 by a bonding agent like glue.

The dimensions of the flanges 1222, 1224 may also differ from the dimensions shown in FIG. 12. The flanges 1222, 1224 may, in particular, comprise a larger extent into a radial direction of the grommet (e.g. radially outward from the passage 1230) or they may comprise a smaller extent. In principle, there may also be no flanges at all.

The grommet defines a passage 1230 through the material of the midsole 1210. In the example shown here, the passage 1230 extends vertically throughout the entire thickness of the midsole 1210, and potentially the entire sole 1200, from its bottom surface to its top surface. The grommet 1220 may thus act as a clima element, allowing an inflow and/or outflow of air. It may allow ventilation of the foot of a wearer and help avoiding excessive sweating. The passage 1230 may furthermore simply be left as empty space as shown here, or it may be filled with a material, e.g. a breathable material that prevents ingress of moisture or dirt into a shoe with sole 1200.

The grommet 1220 may comprise a deformation stiffness in at least one direction that is higher than the deformation stiffness of the expanded material of the midsole 1210. This direction may e.g. a vertical direction, i.e. from the top of FIG. 12 to the bottom, or it may be a horizontal direction, e.g. from the left of FIG. 12 to the right, or any combination thereof.

In certain embodiments, the deformation stiffness of the grommet 1220 is only marginally higher than the deformation stiffness of the expanded material of the midsole 1210. For example, the ratio of the deformation stiffness of the grommet 1220 in a vertical direction to the deformation stiffness of the expanded material of the midsole 1210 may be 1.05:1, it may be 1.1:1, or it may be 1.5:1. In other cases the ratio of the deformation stiffness of the grommet 1220 in a horizontal direction to the deformation stiffness of the expanded material of the midsole 1210 may be 1.05:1, 1.1:1, or 1.5:1, etc.

Figure 13:
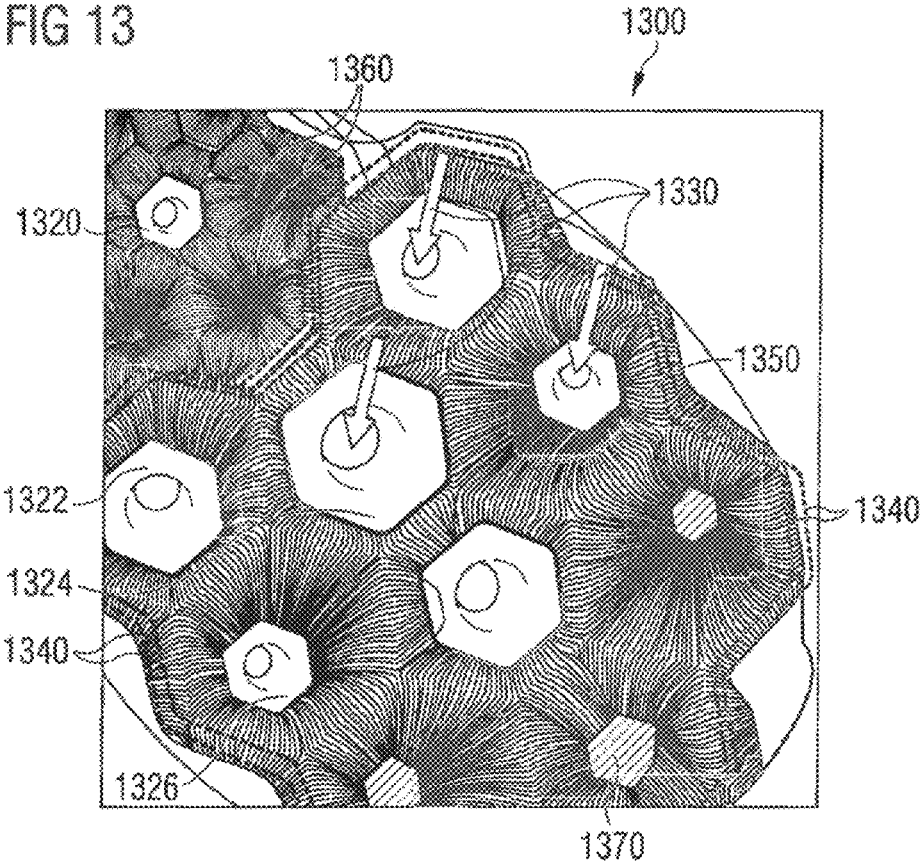
FIG. 13 is a bottom view of a sole with a clima unit comprising a plurality of grommets arranged in a honeycomb manner, according to certain embodiments of the present invention.

An only marginally higher deformation stiffness of the grommet 1220 provides good stability to the sole 1200, in particular, if a plurality of grommets 1220 are arranged into a clima unit, e.g. a honeycomb pattern, as shown in FIG. 13, but at the same time still allows for movements, e.g. elongations, compression and stretch, of the material of the midsole 1210, thereby not hampering a natural roll-off of the foot etc.

It is, however, also possible, that the grommet 1220 comprises a deformation stiffness in a direction that is significantly higher than the deformation stiffness of the expanded material of the midsole 1210, e.g. twice as high, three times as high, 5 times as high, 10 times as high etc.

Moreover, it is in principle also possible that the grommet 1220 comprises a deformation stiffness that is equal or even smaller than the deformation stiffness of the expanded material of the midsole 1210, given the sole 1200 comprises a further element as discussed herein with a higher deformation stiffness in a direction than the expanded material of the midsole 1210.

The grommet 1220 may, for example, comprise one or more of the following materials: a polymeric material, TPU, PA, PU, rubber or other materials.

Finally, FIG. 13 shows other embodiments of a sole 1300 according to the invention. The sole 1300 comprises a midsole with randomly arranged particles of an expanded material. The sole 1300 further comprises a plurality of grommets 1320, 1322, 1324, 1326. Some or all of these grommets 1320, 1322, 1324, 1326 may be the grommet 1220 discussed above in relation to FIG. 12. Insofar, the explanations and considerations put forth above with respect to grommet 1220 also apply the grommets, e.g. grommets 1320, 1322, 1324, 1326, shown in FIG. 13.

The grommets 1320, 1322, 1324, 1326 define passages 1330 through the sole 1300, in particular the midsole of sole 1300. In certain embodiments, as shown here, the grommets 1320, 1322, 1324, 1326 comprise hexagonal flanges. This allows arranging a plurality of grommets 1322, 1324, 1326 into a clima unit, indicated in FIG. 13 by the double line 1340. Such a clima unit 1340 may e.g. be arranged in the heel region of the sole 1300 or the forefoot region, where it might help preventing excessive sweating or heating of the foot of a wearer, thereby improving wellbeing and performance.

However, the grommets may also comprise a different shape and be arranged into a clima unit. They may e.g. be connected to a clima unit by a grid-like structure. Such a clima unit or grid-like structure may also comprise one or more of the materials suitable for a grommet mentioned above, that is: a polymeric material, TPU, PA, PU, rubber or other materials.

The clima unit 1340 may also comprise other elements like elements 1370 that do not define an open passage through the midsole. The elements 1370 may, e.g. be grommets comprising a valve that allows air to escape from the inside of a shoe with sole 1300, but not air to flow into the shoe.

The sole 1300 further comprises a solitary grommet 1320, not part of a clima unit.

Moreover, the sole 1300 comprises a number of indentations 1360, also comprising a hexagonal shape to fit the hexagonal shape of the grommets 1320, 1322, 1324, 1326. These indentations 1360 may e.g. influence the elastic properties of the sole 1300, they may comprise a recess for receiving an electronic component, they may help to save weight, etc.

Finally, the sole 1300 comprises an outsole 1350. The outsole 1350 may help protecting the midsole and in particular the grommets 1320, 1322, 1324, 1326 from dirt, water, abrasion, etc. The outsole 1350 may also provide improved grip to the sole 1300. The outsole 1350 may also stabilize the sole 1300 and in particular help securing the grommets 1320, 1322, 1324, 1326 in their place within the sole 1300.

In the following, further examples are described to facilitate the understanding of the invention:

1. Sole for a shoe, in particular a sports shoe, comprising:

a. a midsole comprising randomly arranged particles of an expanded material; and b. an element which comprises a higher deformation stiffness in at least one direction than the expanded material;

c. wherein the material of the midsole surrounds the element at least partially.

2. Sole according to example 1, wherein the element extends at least partially inside the material of the midsole.

3. Sole according to example 1 or 2, wherein the element is not bonded to the expanded material of the midsole.

4. Sole according to one of the examples 1-3, wherein the particles of the expanded material comprise one or more of the following materials: expanded ethylene-vinyl-acetate, expanded thermoplastic urethane, expanded polypropylene, expanded polyamide, expanded polyether block amide, expanded polyoxymethylene, expanded polystyrene, expanded polyethylene, expanded polyoxyethylene, expanded ethylene propylene diene monomer.

5. Sole according to one of the preceding examples 1-4, wherein the expanded material surrounds the element at least partially.

6. Sole according to one of the preceding examples 1-5, wherein the sole is manufactured by inserting the element into a mold which is subsequently filled with the particles of the expanded material of the midsole.

7. Sole according to example 6, wherein after filling the mold, the particles of the expanded material of the midsole are subjected to a heating- and/or pressurization and/or steaming process.

8. Sole according to one of the preceding examples 1-7, wherein the element extends at least partially like a skeleton throughout the material of the midsole.

9. Sole according to one of the preceding examples 1-8, wherein the element comprises a plurality of rod-shaped sections.

10. Sole according to one of the preceding examples 1-9, wherein the element comprises hollow sections.

11. Sole according to one of the preceding examples 1-10, wherein the element is at least partially grid-like.

12. Sole according to one of the preceding examples 1-11, wherein the element comprises a recess for receiving an electronic component.

13. Sole according to the preceding example 12, wherein the recess is arranged in a region of the element that is not on every side surrounded by the midsole.

14. Sole according to one of the preceding examples 1-13, wherein the sole further comprises a heel clip that is arranged at the material of the midsole.

15. Sole according to example 14, wherein the heel clip comprises a recess in the region of the Achilles' tendon.

16. Sole according to example 14 or 15, wherein the heel clip comprises a medial and a lateral finger that are designed to independently encompass the medial and the lateral side of the heel, respectively.

17. Sole according to one of the examples 14-16, wherein the heel clip and the element are provided as one integral piece.

18. Sole according to one of the preceding examples 1-17, wherein the sole further comprises a cage element which is arranged at the midsole and which is designed to three-dimensionally encompass an upper on a lateral and/or a medial side.

19. Sole according to example 18, wherein the cage element, the element and/or the heel clip are provided as one integral piece.

20. Sole according to one of the preceding examples 1-19, wherein the element at least partially encompasses a part of the expanded material on the side to selectively limit the deformation of the expanded material.

21. Sole according to one of the preceding examples 1-20, wherein an outsole layer is arranged in at least a partial region of the element.

22. Sole according to one of the preceding examples 1-21, wherein the element comprises at least a first plate element and a second plate element that can slide relative to each other.

23. Sole according to example 22, wherein the first plate element can slide in various directions relative to the second plate element.

24. Sole according to examples 22 or 23, wherein the first and the second plate element each comprise a curved sliding surface.

25. Sole according to one of the examples 22-24, wherein the material of the midsole provides a restoring force counteracting a sliding movement of the first plate element relative to the second plate element.

26. Sole according to one of the preceding examples 1-25, wherein the element comprises at least one grommet, defining a passage through the material of the midsole.

27. Sole according to the preceding example 26, wherein the at least one grommet comprises a hexagonal flange.

28. Sole according to one of the preceding examples 26 and 27, wherein the element comprises a clima unit comprising a plurality of grommets arranged in a honeycomb pattern.

29. Shoe, in particular a sports shoe, comprising a sole according to one of the preceding examples 1-28.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A sole for a shoe comprising:

(a) a midsole comprising an expanded material in the form of randomly arranged particles that are directly bonded to one another at their surfaces while substantially retaining their individual particle shapes in the expanded material; and (b) an element comprising a higher deformation stiffness in at least one direction than the expanded material, wherein the element is oriented underneath a foot of a wearer;

(c) wherein the element is at least partially embedded within and is not adhesively bonded to the expanded material of the midsole so that movement of the element is at least partially decoupled from the expanded material of the midsole to selectively increase stability of the expanded material of the midsole; and wherein the element is at least partially embedded within the expanded material of the midsole so that the element does not protrude through a surface of the expanded material of the midsole that faces the foot of the wearer when worn.

2. The sole according to claim 1, wherein the element extends inside the expanded material of the midsole.

3. The sole according to claim 1, wherein the element comprises hollow sections.

4. The sole according to claim 1, wherein the element is at least partially grid-like.

5. The sole according to claim 1, wherein the element comprises a recess for receiving an electronic component.

6. The sole according to claim 1, wherein the sole further comprises a heel clip that is arranged at the expanded material of the midsole, and wherein the heel clip comprises a medial finger and a lateral finger that are designed to independently encompass a medial side and a lateral side of a heel, respectively, of the wearer when the shoe is worn.

7. The sole according to claim 6, wherein the medial finger and the lateral finger are separated from each other by a recess formed in a region that corresponds to a location of an Achilles' tendon of the wearer when the shoe is worn.

8. The sole according to claim 1, wherein the element at least partially encompasses a part of the expanded material on a side to selectively limit deformation of the expanded material.

9. The sole according to claim 1, wherein the element comprises at least a first plate element and a second plate element that can slide relative to each other.

10. The sole according to claim 9, wherein the first and the second plate element each comprise a curved sliding surface.

11. The sole according to claim 9, wherein the material of the midsole provides a restoring force counteracting a sliding movement of the first plate element relative to the second plate element.

12. The sole according to claim 1, wherein the element comprises at least one grommet, defining a passage through the material of the midsole.

13. The sole according to claim 12, wherein the element comprises a claim unit comprising a plurality of grommets arranged in a honeycomb pattern.

14. A sole for a shoe comprising:

(a) a midsole comprising an expanded material in the form of randomly arranged particles that are directly bonded to one another at their surfaces while substantially retaining their individual particle shapes in the expanded material; and (b) an element comprising a higher deformation stiffness in at least one direction than the expanded material, wherein the element is oriented underneath a foot of a wearer;

(c) wherein the element is at least partially embedded within and is not adhesively bonded to the expanded material of the midsole so that movement of the element is at least partially decoupled from the expanded material of the midsole to selectively increase stability of the expanded material of the midsole and the element extends at least partially like a skeleton throughout the expanded material of the midsole; and wherein the element is at least partially embedded within the expanded material of the midsole so that the element does not protrude through a surface of the expanded material of the midsole that faces the foot of the wearer when worn.

15. The sole according to claim 14, wherein the element comprises a recess for receiving an electronic component.

16. The sole according to claim 14, wherein the sole further comprises a heel clip that is arranged at the expanded material of the midsole, and wherein the heel clip comprises a medial finger and a lateral finger that are designed to independently encompass a medial side and a lateral side of a heel, respectively, of the wearer when the shoe is worn.

17. The sole according to claim 16, wherein the medial finger and the lateral finger are separated from each other by a recess formed in a region that corresponds to a location of an Achilles' tendon of the wearer when the shoe is worn.

18. The sole according to claim 14, wherein the element comprises at least a first plate element and a second plate element that can slide relative to each other.

19. The sole according to claim 18, wherein the first and the second plate element each comprise a curved sliding surface.

20. The sole according to claim 14, wherein the element comprises at least one grommet, defining a passage through the material of the midsole.

21. A shoe comprising a sole comprising:

(a) a midsole comprising an expanded material in the form of randomly arranged particles that are directly bonded to one another at their surfaces while substantially retaining their individual particle shapes in the expanded material; and (b) an element comprising a higher deformation stiffness in at least one direction than the expanded material, wherein the element is oriented underneath a foot of a wearer;

(c) wherein the element is at least partially embedded within and is not adhesively bonded to the expanded material of the midsole so that movement of the element is at least partially decoupled from the expanded material of the midsole to selectively increase stability of the expanded material of the midsole; and wherein the element is at least partially embedded within the expanded material of the midsole so that the element does not protrude through a surface of the expanded material of the midsole that faces the foot of the wearer when worn.

22. The shoe to claim 21, wherein the sole further comprises a heel clip that is arranged at the expanded material of the midsole, and wherein the heel clip comprises a medial finger and a lateral finger that are designed to independently encompass a medial side and a lateral side of a heel, respectively, of the wearer when the shoe is worn.

23. The shoe according to claim 22, wherein the medial finger and the lateral finger are separated from each other by a recess formed in a region that corresponds to a location of an Achilles' tendon of the wearer when the shoe is worn.

* * * * *